US007284712B2

(12) United States Patent
Funai et al.

(10) Patent No.: US 7,284,712 B2
(45) Date of Patent: Oct. 23, 2007

(54) INJECTOR HAVING STRUCTURE FOR CONTROLLING NOZZLE NEEDLE

(75) Inventors: Kenji Funai, Kariya (JP); Masatoshi Kuroyanagi, Kariya (JP); Akira Shibata, Anjo (JP); Kenji Date, Obu (JP)

(73) Assignee: Denso Corporation, Kariya, Aichi-pref (JP)

( * ) Notice: Subject to any disclaimer, the term of this patent is extended or adjusted under 35 U.S.C. 154(b) by 386 days.

(21) Appl. No.: 11/115,296

(22) Filed: Apr. 27, 2005

(65) Prior Publication Data

US 2005/0242211 A1 Nov. 3, 2005

(30) Foreign Application Priority Data

| | | |
|---|---|---|
| Apr. 30, 2004 | (JP) | 2004-135371 |
| Jan. 28, 2005 | (JP) | 2005-020904 |
| Feb. 17, 2005 | (JP) | 2005-040730 |
| Mar. 10, 2005 | (JP) | 2005-067272 |

(51) Int. Cl.

| | |
|---|---|
| ***F02M 47/02*** | (2006.01) |
| ***F02M 59/00*** | (2006.01) |
| ***B05B 1/30*** | (2006.01) |

(52) U.S. Cl. ..... 239/533.1; 239/533.2; 239/585.1; 239/585.5; 239/88; 239/96

(58) Field of Classification Search ..... 239/533.1, 239/533.2, 533.8, 533.9, 585.1, 585.3, 585.4, 239/585.5, 88–91, 96; 251/127
See application file for complete search history.

(56) References Cited

U.S. PATENT DOCUMENTS

| | | | | |
|---|---|---|---|---|
| 4,603,671 | A * | 8/1986 | Yoshinaga et al. | 123/467 |
| 4,628,881 | A * | 12/1986 | Beck et al. | 123/447 |
| 5,355,856 | A * | 10/1994 | Paul et al. | 123/446 |
| 5,709,342 | A * | 1/1998 | McCauley | 239/585.5 |
| 6,237,570 | B1 | 5/2001 | Aoki et al. | |
| 2004/0000600 | A1 | 1/2004 | Peters et al. | |
| 2006/0043209 | A1 | 3/2006 | Magel | |

FOREIGN PATENT DOCUMENTS

| | | | |
|---|---|---|---|
| DE | 10136595 | A1 | 9/2002 |
| EP | 0615064 | A1 | 2/1993 |
| EP | 1164283 | A2 | 12/2001 |
| JP | 8-49620 | | 2/1996 |
| JP | 2000-87821 | | 3/2000 |
| JP | 2002-263855 | | 9/2002 |

OTHER PUBLICATIONS

Chinese Office Action mailed Apr. 13, 2007 in corresponding Chinese Application No. 200510066868.2, together with an English translation.

French Search Report dated Mar. 1, 2007.

* cited by examiner

*Primary Examiner*—Davis D. Hwu
(74) *Attorney, Agent, or Firm*—Nixon & Vanderhye P.C.

(57) ABSTRACT

A valve back pressure chamber is provided to exert a back pressure of a first valve needle. Furthermore, a hydraulic pressure passage is provided to extend through the valve back pressure chamber. A valve body is provided to a second valve needle and is driven to connect and disconnect between the hydraulic pressure passage and a fuel tank and thereby to drive the first valve needle. The second valve needle is driven by hydraulic pressure induced by an actuator.

6 Claims, 20 Drawing Sheets

INJECTOR HAVING STRUCTURE FOR CONTROLLING NOZZLE NEEDLE

CROSS REFERENCE TO RELATED APPLICATION

This application is based on and incorporates herein by reference Japanese Patent Application No. 2004-135371 filed on Apr. 30, 2004, Japanese Patent Application No. 2005-20904 filed on Jan. 28, 2005, Japanese Patent Application No. 2005-40730 filed on Feb. 17, 2005 and Japanese Patent Application No. 2005-67272 filed on Mar. 10, 2005.

BACKGROUND OF THE INVENTION

1. Field of the Invention

The present invention relates to an injector and more particularly to a structure for controlling a nozzle needle of the injector, which is driven to enable and disable inject fuel.

2. Description of Related Art

In an injector used in a common rail type fuel injection system of a diesel engine, a nozzle needle, which is driven to enable and disable fuel injection, is controlled by an actuator, such as a solenoid, to freely set fuel injection timing and an amount of fuel injection and thereby to achieve advanced fuel injection. One previously proposed injector includes a nozzle needle back pressure chamber, which exerts a back pressure of the nozzle needle upon supply of pressurized fuel (see, for example, Japanese Unexamined Patent Publication No. H08-49620). When the pressure of the nozzle needle back pressure chamber is increased or decreased, the nozzle needle is moved between a seated position and a lifted position relative to a valve seat. A release passage and a control valve chamber are formed in the injector. The release passage releases the pressure of the nozzle needle back pressure chamber to a low pressure source, and the control valve chamber forms an intermediate pat of the release passage. When a control valve, which is arranged in the control valve chamber, is driven to enable and disable communication between the nozzle needle back pressure chamber and the low pressure source, the pressure of the nozzle needle back pressure chamber is increased and decreased. The control valve is seatable against a seat formed in an outer peripheral part of a port of the control valve chamber, which is communicated with the nozzle needle back pressure chamber. The pressure of fuel of the port is applied to the control valve in a valve opening direction, and a spring force is applied to the control valve in a valve closing direction. When the solenoid attracts an armature, which is formed integrally with the control valve, the control valve is lifted against the spring force.

Here, the spring force is set to maintain the closed state of the control valve at the time of deenergizing of the solenoid. The required attractive force of the solenoid is determined based on the spring force.

When downsizing of the actuator (e.g., downsizing of the solenoid) needs to be achieved, the attractive force of the solenoid is also reduced due to a decrease in a magnetic surface area of the solenoid. Thus, the spring force should be also reduced, and the fuel pressure, which is applied to the control valve in the lifting direction, should be also reduced.

The fuel pressure, which is applied to the control valve in the lifting direction, can be reduced by sufficiently reducing a diameter of the seat of the control valve to reduce a pressure receiving surface area. However, due to the choking effect or throttling effect induced by reducing of the diameter of the seat, a pressure decreasing speed of the nozzle needle back pressure chamber may be excessively slowed to affect the responsibility of the nozzle needle. Furthermore, when an orifice is provided in the release passage to adjust the pressure decreasing speed of the nozzle needle back pressure chamber, an adjustable range is relatively narrow due to the above throttling effect. When the passage cross sectional area in the opened state of the control valve needs to be increased, the lift amount of the control valve can be increased. However, the attractive force of the solenoid valve is inversely proportional to a distance between the armature and the magnetic pole. Thus, in the case of increasing the lift amount of the control valve, a relatively large attractive force is required, and therefore the downsizing of the solenoid cannot be achieved.

SUMMARY OF THE INVENTION

The present invention addresses the above disadvantage. Thus, it is an objective of the present invention to provide an injector, which includes an actuator of a minimum size and which achieves a sufficient passage cross sectional area at time of opening a control valve.

To achieve the objective of the present invention, there is provided an injector, which includes an elongated base body. An injection hole penetrates through a wall of the base body to inject fuel. A nozzle chamber is directly communicated with the injection hole on an upstream side of the injection hole in the base body and is supplied with pressurized fuel. A nozzle needle is located in the nozzle chamber and is driven to enable and disable injection of the fuel through the injection hole. A nozzle needle back pressure chamber is formed adjacent to a base end of the nozzle needle in the base body and is supplied with pressurized fuel to exert a back pressure of the nozzle needle for urging the nozzle needle toward the injection hole. A release passage is formed in the base body to release the pressure of the nozzle needle back pressure chamber to an external low pressure source. A control valve chamber is located in an intermediate part of the release passage in the base body. A first control valve is located in the control valve chamber and is driven to connect and disconnect between the nozzle needle back pressure chamber and the low pressure source. A valve drive means for driving the first control valve is provided. The valve drive means is a hydraulic valve drive means that includes a hydraulic pressure passage, a second control valve and an actuator. The hydraulic pressure passage is formed in the base body, such that the hydraulic pressure passage is supplied with pressurized fuel and applies the pressurized fuel to the first control valve as control hydraulic fluid for driving the first control valve. The second control valve is driven to control a flow of the fuel in the hydraulic pressure passage. An actuator drives the second control valve.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
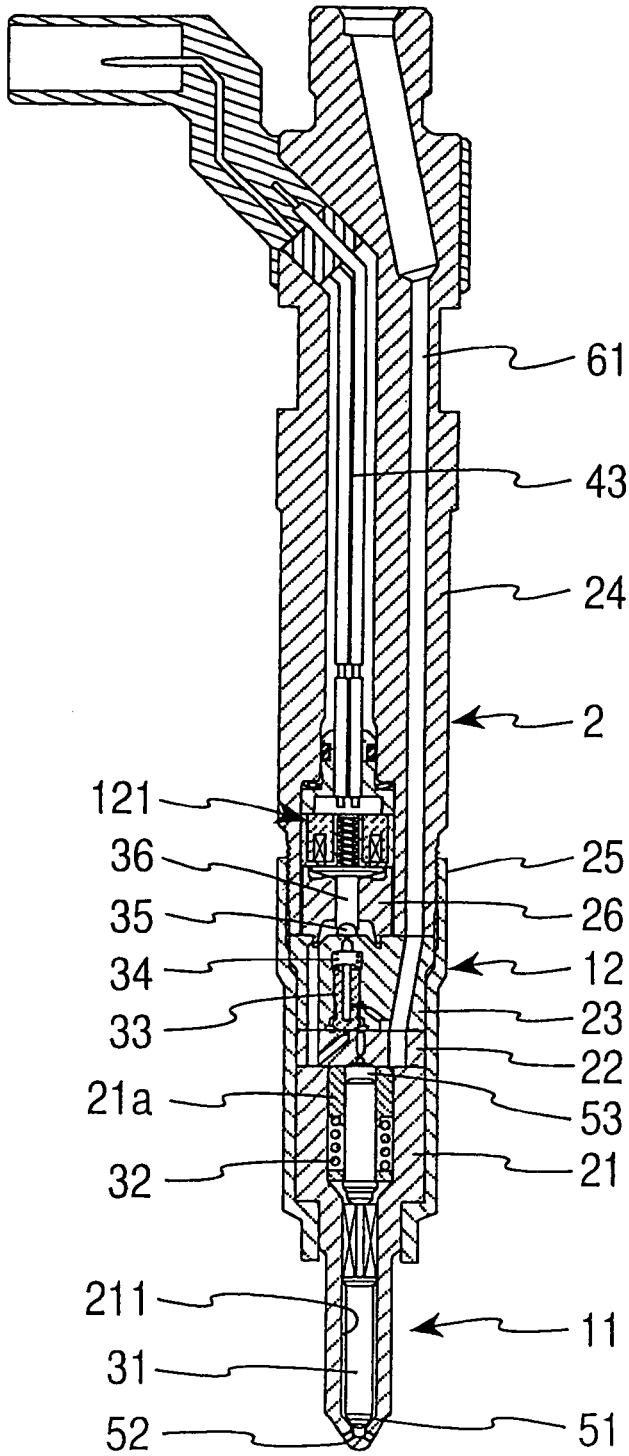
FIG. 1 is a cross sectional view of a injector according to a first embodiment of the present invention.
Figure 2:
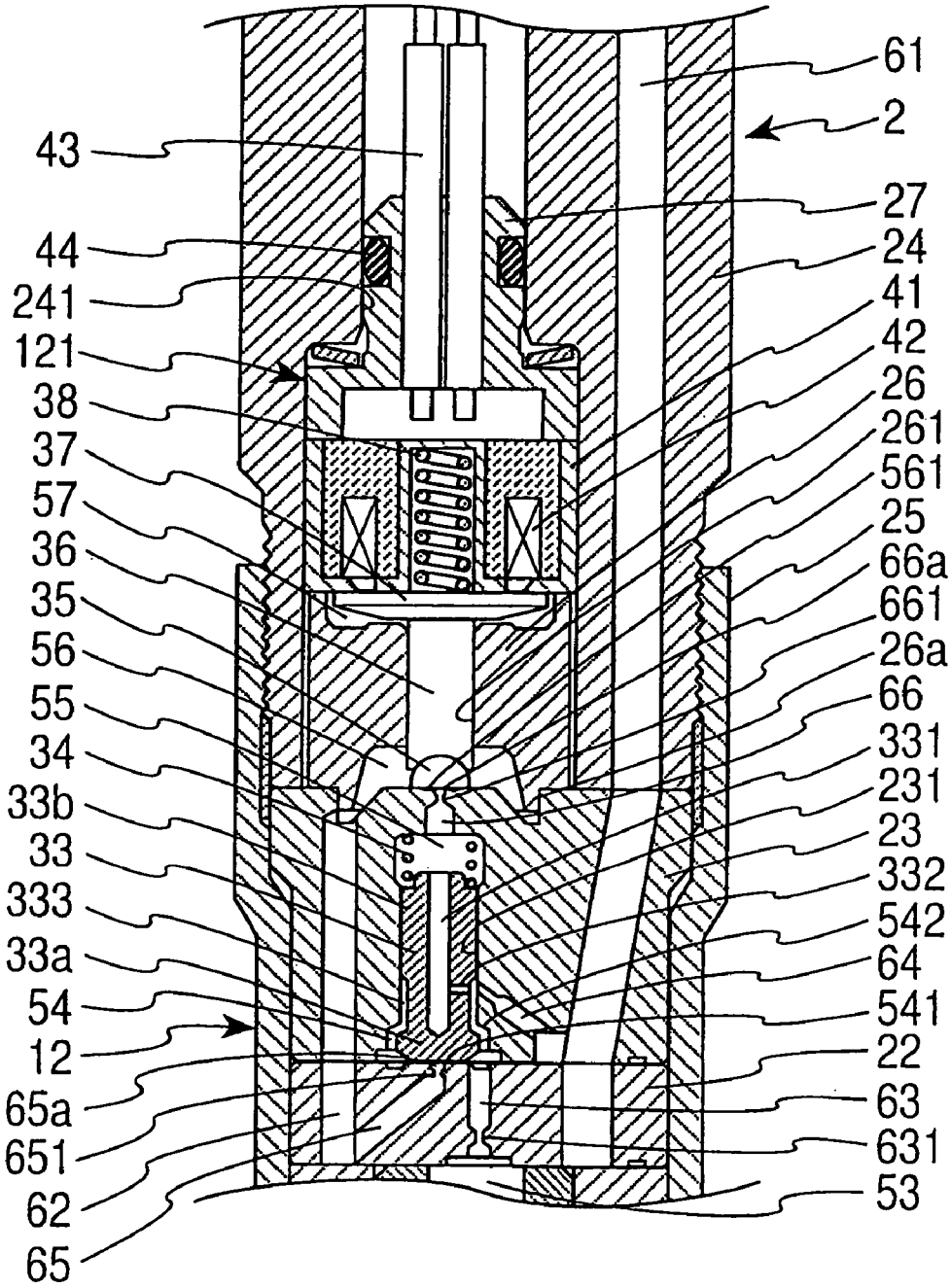
FIG. 2 is an enlarged partial cross sectional view of the injector of the first embodiment.

FIGS. 1 and 2 show a structure of an injector according to a first embodiment of the present invention. The injector is used in an internal combustion engine, such as, a diesel engine having a common rail type fuel injection system and is provided to each cylinder of the engine. The injector is controlled by an ECU to inject fuel, which is supplied from a common rail, for a predetermined time period.

The injector includes an elongated base body 2 of a generally cylindrical configuration. The base body 2 includes a nozzle body 21, a distance piece 22, a first valve body 23, a holder 24 and a retaining nut 25. The nozzle body 21, the distance piece 22, the valve body 23 and the holder 24 are axially arranged in this order from a downstream end side of the injector and are held together by the retaining nut 25.

Various recesses and holes are formed in the base body 2 to receive corresponding components and to form fuel passages. A nozzle arrangement 11, which projects into a combustion chamber of the corresponding cylinder, is provided in a lower end of the injector, which is a bottom side in FIG. 1. The nozzle arrangement 11 includes the nozzle body 21. A longitudinal hole 211 extends in an axial direction of the base body 2, and a nozzle needle 31 is received in the longitudinal hole 211. A tubular member 21*a* is press fitted into the longitudinal hole 211 at an upper end of the nozzle body 21, and an upper end of the nozzle needle 31 is slidably received in the tubular member 21*a*.A lower end of the longitudinal hole 211 extends to a lower distal end of the nozzle body 21 and forms a nozzle chamber 51. Injection holes 52 penetrate through a base wall of the nozzle chamber 51 of the nozzle body. 21. On the lower end side of the sliding portion of the nozzle needle 31, the longitudinal hole 211 is communicated with a high pressure passage 61, which serves as a fuel supply passage and is formed in the distance piece 22, the first valve body 23 and the holder 24. When the nozzle needle 31 is lifted away from a valve seat provided at the nozzle chamber 51, the pressurized fuel (high pressure fuel), which is supplied from the common rail, is injected through the injection holes 52.

A coil spring 32 is received in the longitudinal hole 211 and is held around the nozzle needle 31 to urge the nozzle needle 31 in the downward direction, i.e., in a seating direction. A nozzle needle back pressure chamber 53, which exerts the back pressure of the nozzle needle 31, is defined above the sliding portion of the nozzle needle 31 at a location adjacent to a base end of the nozzle needle 31. More specifically, the distance pieces 22 forms an upper wall of the nozzle needle back pressure chamber 53, and the upper end (the base end) of the nozzle needle 31 forms the lower wall of the nozzle needle back pressure chamber 53. The fuel pressure is applied from the high pressure passage 61 to the nozzle needle 31 in the lifting direction of the nozzle needle 31, which is away from the valve seat. When the pressure of the needle back pressure chamber 53 becomes equal to or less than a predetermined valve opening start pressure, the nozzle needle 31 is lifted from the valve seat. When the pressure of the needle back pressure chamber 53 becomes equal to or greater than a valve closing start pressure, the nozzle needle 31 is seated against the valve seat to stop the fuel injection.

The switching of the pressure of the nozzle needle back pressure chamber 53 is performed by the following structure. A longitudinal hole 231 extends in the first valve body 23 in the axial direction of the injector, and a cross sectional area of a lower end of the longitudinal hole 231 is enlarged to form an enlarged diameter portion (an enlarged cross sectional portion) of the longitudinal hole 231, which constitutes a first control valve chamber 54. A first valve needle 33, which serves as a first control valve, is located in the first control valve chamber 54. The first valve needle 33 is formed into a cylindrical body and includes a neck, which has a reduced diameter, near the lower end of the first valve needle 33. A shaft portion 33*b* of the first valve needle 33, which is located above the neck of the first valve needle 33 in FIG. 2, is slidably held by a small diameter portion of the longitudinal hole 231. The lower end side of the first valve needle 33, which is below the neck of the first valve needle 33, projects into the first control valve chamber 54 to form a valve body 33*a*.The diameter of the first valve needle valve body portion 33*a* is slightly larger than that of the shaft portion 33*b*, and an annular space is formed between the first valve needle valve body 33*a* and an inner peripheral wall surface of the first control valve chamber 54. The upper end and the lower end of the first valve needle valve body portion 33*a* are chamfered to have tapered surfaces, respectively. The first valve needle 33 is urged downward by a spring force of a coil spring 34.

The distance piece 22 is interposed between the first valve body 23, which forms the first control valve chamber 54, and the nozzle body 21, which forms the nozzle needle back pressure chamber 53. Thus, the distance piece 22 forms a lower wall portion of the first control valve chamber 54 and an upper wall portion of the nozzle needle back pressure chamber 53. Furthermore, a through hole penetrates through the distance piece 22 in the axial direction of the injector to form a communication passage 63, which always communicates between the first control valve chamber 54 and the needle back pressure chamber 53. An orifice (a choke) 631 is formed in an intermediate location of the communication passage 63.

A high pressure branch passage (a communication passage) 64 having an orifice (a choke) is formed in the first valve body 23 having the first control valve chamber 54. The high pressure branch passage 64 is branched from the high pressure passage 61 and is communicated with the first control valve chamber 54. A distal end of the high pressure branch passage 64 is opened in a peripheral wall surface of the longitudinal hole 231 at the neck of the first valve needle 33 and is always communicated with the outer peripheral annular space 333 of the neck of the first valve needle 33. A low pressure branch passage 65 is formed in the distance piece 22. The low pressure branch passage 65 is branched from a low pressure passage 62 and is communicated with the first control valve chamber 54. The low pressure branch passage 65 is opened in the lower wall surface of the first control valve chamber 54 at an opposed position, which is opposed to the lower end surface of the first valve needle valve body 33*a*.The open end of the low pressure branch passage 65 forms a port 65*a*.The port 65*a* is closed when the first valve needle 33 is moved downward and is engaged with the lower wall surface of the first control valve chamber 54. An outer peripheral edge of this open end of the low pressure branch passage 65 forms a seat (a lower seat), to which the first valve needle 33 is seated. When the first valve needle 33 is moved upward, the upper tapered portion of the first valve needle valve body 33*a* is seated against a stepped surface of the first control valve chamber 54, which forms a seat (an upper seat) 542.

An orifice 651, which serves as a choke, is formed in the low pressure branched passage 65 at a location immediately downstream of the port 65*a*.

A valve drive arrangement 12, which serves as a valve drive means (a hydraulic drive means) for controlling the first valve needle 33, will be described below. The first valve needle 33 is moved through an increase or a decrease of a pressure of a valve back pressure chamber 55, which is formed above the shaft portion 33*b*.The valve back pressure chamber 55 receives the high pressure fuel from the high pressure passage 61 and the high pressure branch passage 64 through a longitudinal hole 331 and a lateral hole 332 of the first valve needle 33. The longitudinal hole 331 extends from an upper end surface of the first valve needle 33 to the neck of the first valve needle 33. The lateral hole 332 radially extends from an outer peripheral surface of the first valve needle 33 to the longitudinal hole 331 at the neck of the first valve needle 33.

The valve back pressure chamber 55 is communicated with a second control valve chamber 56 through a communication passage 66. The communication passage 66 is formed as a small diameter hole, which extends from a top of the longitudinal hole 231 of the first valve body 23 to an upper end surface of the first valve body 23. An orifice (a choke) 661 is formed in an intermediate point of the communication passage 66.

The second control valve chamber 56 is formed by the first valve body 23 and a recess formed in a lower end surface of a second valve body 26. The first valve body 23 forms a lower end wall of the second control valve chamber 56. An outer peripheral edge 26*a* of the recess of the lower end surface of the second valve body 26 forms an annular projection, which is press fitted to an annular groove formed in the upper end surface of the first valve body 23, so that the first valve body 23 and the second valve body 26 are fitted together.

In the second control valve chamber 56, the opening end of the communication passage 66, which is opened at the lower wall surface of the second control valve chamber 56, forms a port 66*a* that is communicated with the valve back pressure chamber 55. The second control valve chamber 56 is always communicated with the low pressure passage 62 at an outer peripheral edge of the second control valve chamber 56.

A longitudinal hole 261, which extends through an upper wall of the second control valve chamber 56, is formed in the second valve body 26. A second valve needle 36 is slidably received in the longitudinal hole 261. A lower end of the second valve needle 36 projects into the second control valve chamber 56, and an upper end of the second valve needle 36 projects in a solenoid chamber (a receiving chamber) 57, which is located at an upper side of the second valve body 26.

The lower end of the second valve needle 36 holds a valve body 35, which serves as a second control valve that has a semispherical shape. The second valve needle 36 moves integrally with the valve body 35. A flat lower end surface of the valve body 35 is opposed to the lower wall surface of the second control valve chamber 56 and the port 66*a*.A seat surface 561, to which the valve body 35 is seated, is formed in an outer peripheral edge of the port 66*a*.When the valve body 35 is seated against the seat surface 561, the communication between the second valve chamber 56 and the valve back pressure chamber 55 is disconnected.

A circular disk shaped armature 37 is secured to an upper end of the second valve needle 36, which projects into the solenoid chamber 57. The armature 37 is opposed to a magnetic pole surface of a solenoid (actuator) 121 arranged in the solenoid chamber 57. In the solenoid 121, coils 42 are wound around an annular space of a stator 41, which includes two coaxial cylindrical bodies. Electric power is supplied from lead wires 43 to the coils 42. A coil spring 38 is radially inwardly received in the stator 41 and resiliently contacts the armature 37. The coil spring 38 urges the armature 37 in a direction away from the stator 41. The solenoid 121 is clamped between the second valve body 26 and a closing member 27 and is received in a longitudinal hole 241 of the holder 24 along with the second valve body 26 and the closing member 27. A seal member 44 seals between the closing member 27 and the holder 24.

Figure 3:
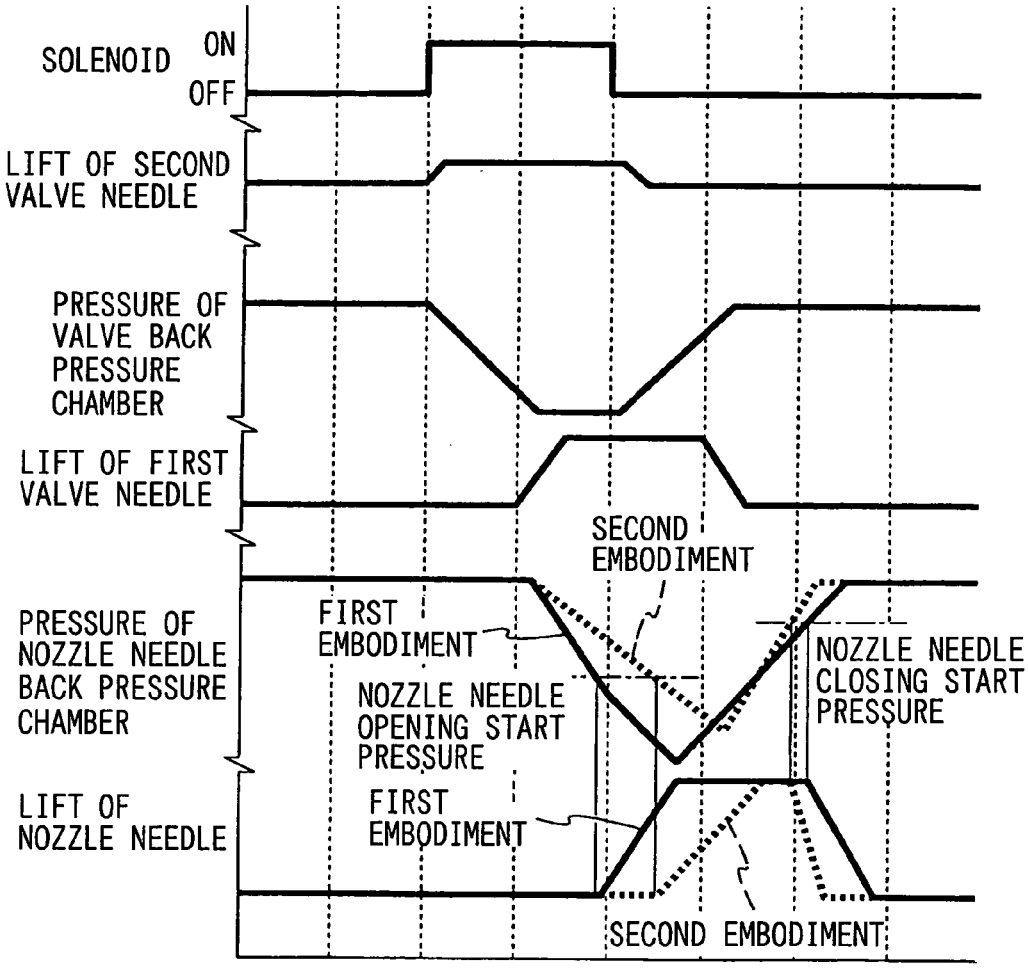
FIG. 3 is a timing chart showing various operational states of the injector of the first embodiment.
Figure 4A:
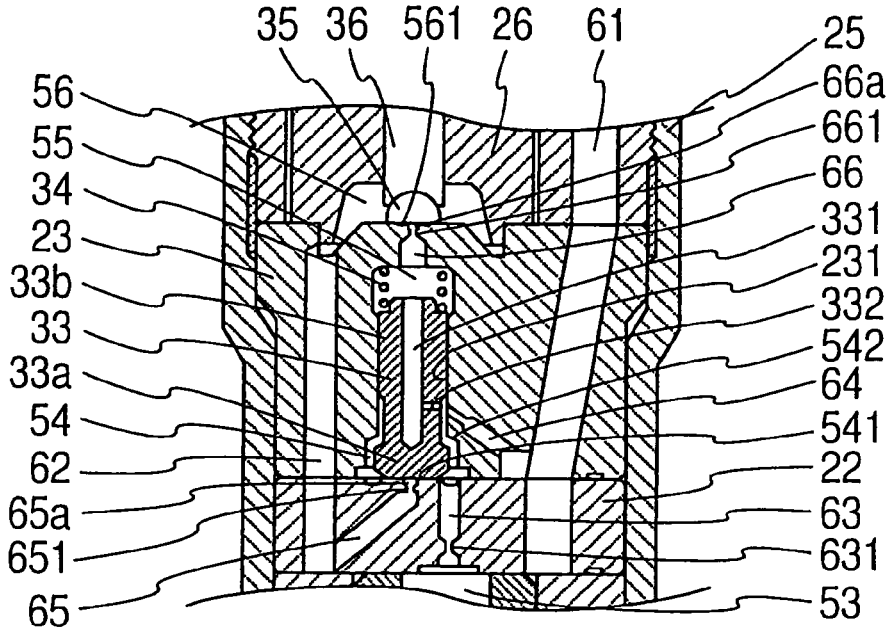
FIG. 4A is a cross sectional view of the injector of the first embodiment, showing a closed state of a nozzle needle.
Figure 4B:
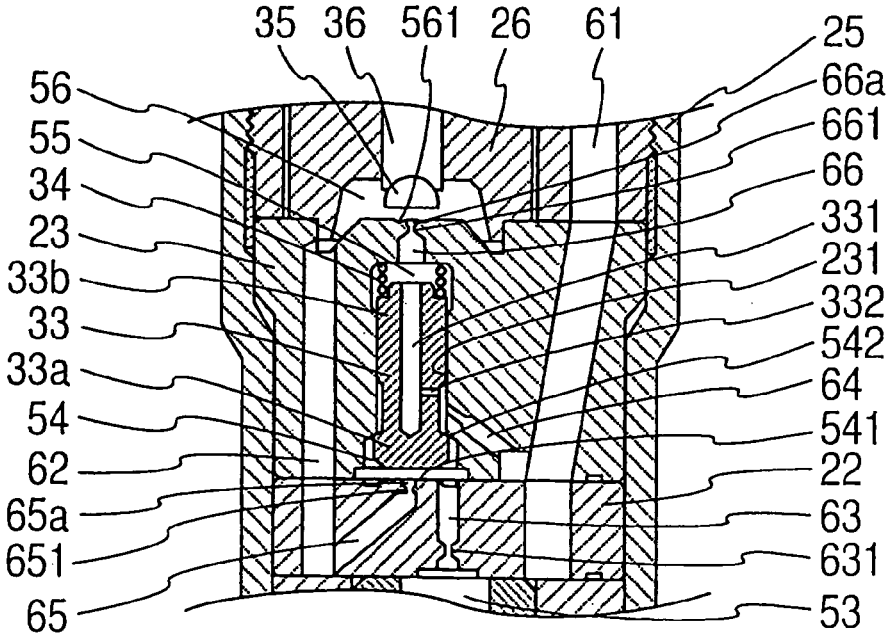
FIG. 4B is a cross sectional view of the injector of the first embodiment, showing an opened state of the nozzle needle.

FIG. 3 is a timing chart for describing an operation of the injector. When the solenoid 121 is turned on, the nozzle needle 31 is lifted away from the valve seat, resulting in valve opening of the nozzle needle 31. When the solenoid 121 is turned off, the nozzle needle 31 is seated against the valve seat, resulting in valve closing of the nozzle needle 31. FIG. 4A shows a state at the time of valve closing of the nozzle needle 31, and FIG. 4B shows a state at the time of valve opening of the nozzle needle 31. When the solenoid 121 is energized, the solenoid 121 attracts the armature 37, so that the second valve needle 36 is moved upward. Here, the high pressure passage 61, the high pressure branch passage 64, the lateral hole 332 of the first valve needle 33, the longitudinal hole 331 of the first valve needle 33, the valve back pressure chamber 55, the communication passage 66, the second control valve chamber 56 and the low pressure passage 62 form a hydraulic pressure passage. In this hydraulic pressure passage, the fuel of the valve back pressure chamber 55 is returned to a fuel tank 3 (FIG. 5), which serves as a low pressure source, through the communication passage 66, the second control valve chamber 56 and the low pressure passage 62 in this order. The first valve needle 33 is lifted away from the lower seat 541 and is seated against the upper seat 542. In this state, since the first valve needle 33 is seated against the upper seat 542, the communication between the first control valve chamber 54 and the high pressure passage 61 is disconnected, and the supply of the high pressure fuel to the first control valve chamber 54 is disabled. Furthermore, since the first valve needle 33 is lifted away from the lower seat 541, a release passage, which includes the communication passage 63, the first control valve chamber 54, the low pressure branch passage 65 and the low pressure passage 62, is opened. Thus, the fuel of the nozzle needle back pressure chamber 53 is returned to the fuel tank 3, so that the pressure of the nozzle needle back pressure chamber 53 is drained to the fuel tank 3 and is thus reduced. When the pressure of the nozzle needle back pressure chamber 53 becomes equal to or less than the valve opening start pressure, the nozzle needle 31 is lifted, i.e., is opened.

In contrast, when the solenoid 121 is turned off, i.e., is deenergized, and thereby the second valve needle 36 is moved downward, the communication between the valve back pressure chamber 55 and the low pressure passage 62 is disconnected. Thus, the pressure of the valve back pressure chamber 55 is increased by the high pressure fuel that is supplied to the valve back pressure chamber 55 through the passage, which includes the high pressure passage 61, the high pressure branch passage 64, the lateral hole 332 of the first valve needle 33 and the longitudinal hole 331 of the first valve needle 33. In this way, the first valve needle 33 is lifted away from the upper seat 542 and is seated against the lower seat 541. In this state, the communication between the first control valve chamber 54 and the lower pressure chamber 62 is disconnected, and the high pressure fuel is supplied to the needle back pressure chamber 53 through the corresponding passage, which includes the high pressure passage 61, the high pressure branch passage 64, the first control valve chamber 54 and the communication passage 63. Thus, the pressure of the nozzle needle back pressure chamber 53 is increased. When the pressure of the nozzle needle back pressure chamber 53 becomes equal to or greater than the valve closing start pressure, the nozzle needle 31 is seated against the valve seat, i.e., is placed in the valve closed state.

Figure 5:
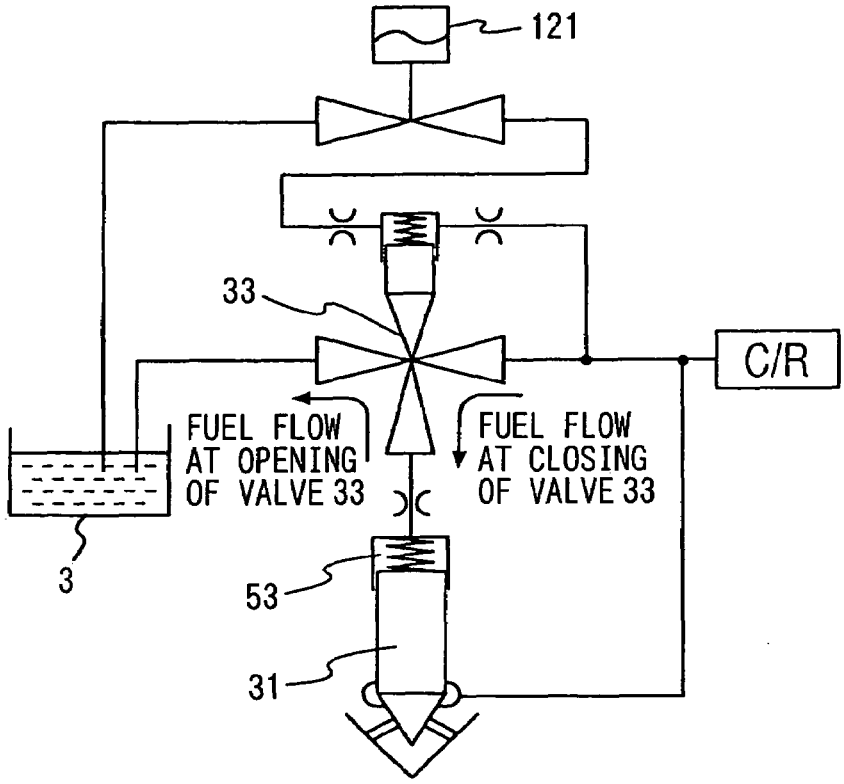
FIG. 5 is a schematic diagram showing a flow of fuel, which serves as control fluid, according to the first embodiment.
Figure 6:
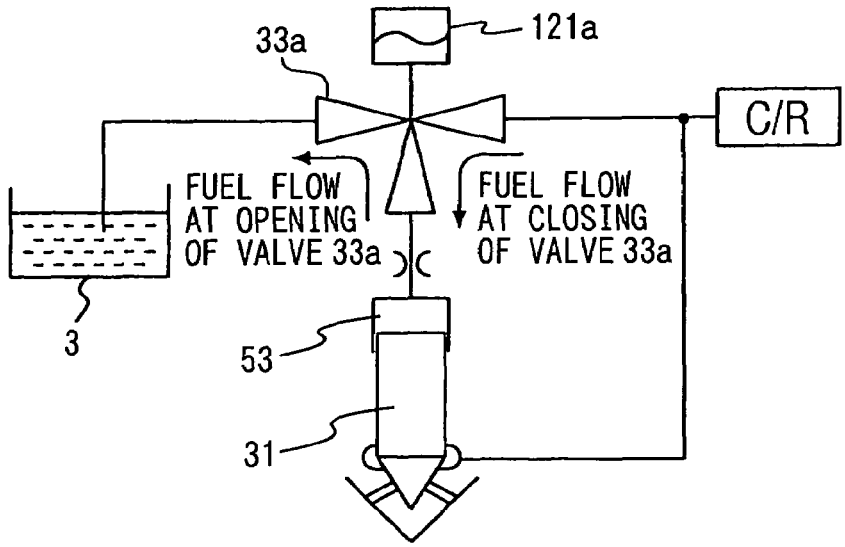
FIG. 6 is a schematic diagram showing a flow of fuel, which serves as control fluid, according to a previously proposed technique.

The injector of the present embodiment is constructed in the above manner. FIG. 5 shows a schematic view of the control system of the nozzle needle 31 according to the first embodiment. In a previously proposed injector shown in FIG. 6, the use of a three way valve 33*a* as the valve needle for controlling the nozzle needle 31 by switching the back pressure of the nozzle needle 31 between the high pressure and the low pressure is the same as that of FIG. 5. However, in the case of FIG. 6, the valve needle 33*a* is directly driven by a solenoid 121*a*.In contrast, in the case of the injector shown in FIG. 5, the valve needle 33 is controlled by the hydraulic pressure, which is in turn controlled by the solenoid 121. Thus, unlike the previously proposed injector shown in FIG. 6, the required drive force can be set without depending on the specification of the solenoid 121, 121*a*.

In this way, the seat diameter and the lift amount of the first valve needle 33 can be made large enough regardless of the size of the solenoid 121. Thus, the operational characteristics of the nozzle needle 31 can be more freely adjusted by the orifice 631 that is provided in the communication passage 63, which communicates between the nozzle needle back pressure chamber 53 and the first control valve chamber 54.

Figure 7:
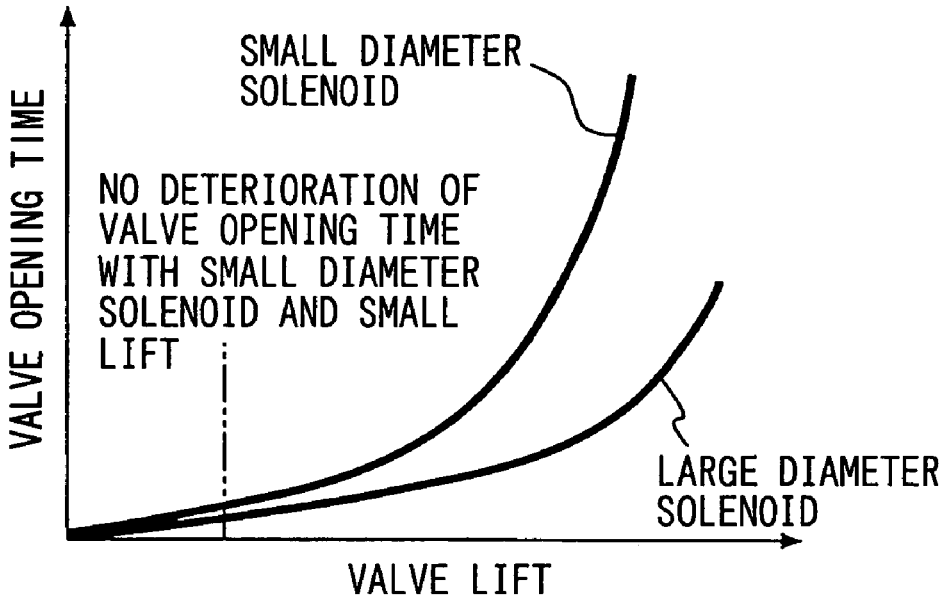
FIG. 7 is a diagram showing an operation of-the injector of the first embodiment.

FIG. 7 shows a relationship between the lift amount of the valve and the time (valve opening time) required to achieve the lift amount of the valve in the case where the valve is driven by the solenoid. More specifically, in comparison of a small diameter solenoid, which has a small magnetic attractive force for attracting the armature, and a large diameter solenoid, which has a large magnetic attractive force for attracting the armature, the large diameter solenoid exhibits shorter valve opening time due to its large magnetic attractive force. However, in a case where the lift amount of the valve is small, there is no significant difference between the small diameter solenoid and the large diameter solenoid. Thus, even in the case where the small diameter solenoid, which has the insufficient drive force for directly driving the valve, is used, the valve opening time is not substantially deteriorated when the control valve is driven by the hydraulic pressure, and the control valve, which opens and closes the hydraulic passage, is driven by the small diameter solenoid, as in the case of the present injector. Alternatively, the operational response characteristics may be measured in advance, and the energization time period of the solenoid may be corrected in response to the fuel injection timing, which is required based on the result of the measurement of the operational response characteristics to compensate an error in the operational response.

Furthermore, in the injector of the present embodiment, as discussed above, the orifice 651 is formed adjacent to the port 65*a* on the downstream side of the port 65*a* in the low pressure branch passage 65, which extends from the port 65*a* of the first control valve chamber 54 to the low pressure passage 62. Thus, even when the first valve needle 33 is lifted from the lower seat 541, the pressure in the space between the first valve needle 33 and the lower seat 541 does not decrease rapidly due to the throttling effect of the orifice 651. Therefore, the relatively high pressure remains in the space between the first valve needle 33 and the lower seat 541 at the time of lifting the first valve needle 33 from the lower seat 541. This remaining pressure is exerted in the accelerating direction for accelerating the valve opening of the first valve needle 33 by assisting the lifting of the first valve needle 33, and this remaining pressure is also exerted in the direction for maintaining the lifting of the first valve needle 33. Thus, the operational stability of the first valve needle 33 is increased, and the operational variations of the injector can be alleviated.

Second Embodiment

Figure 8:
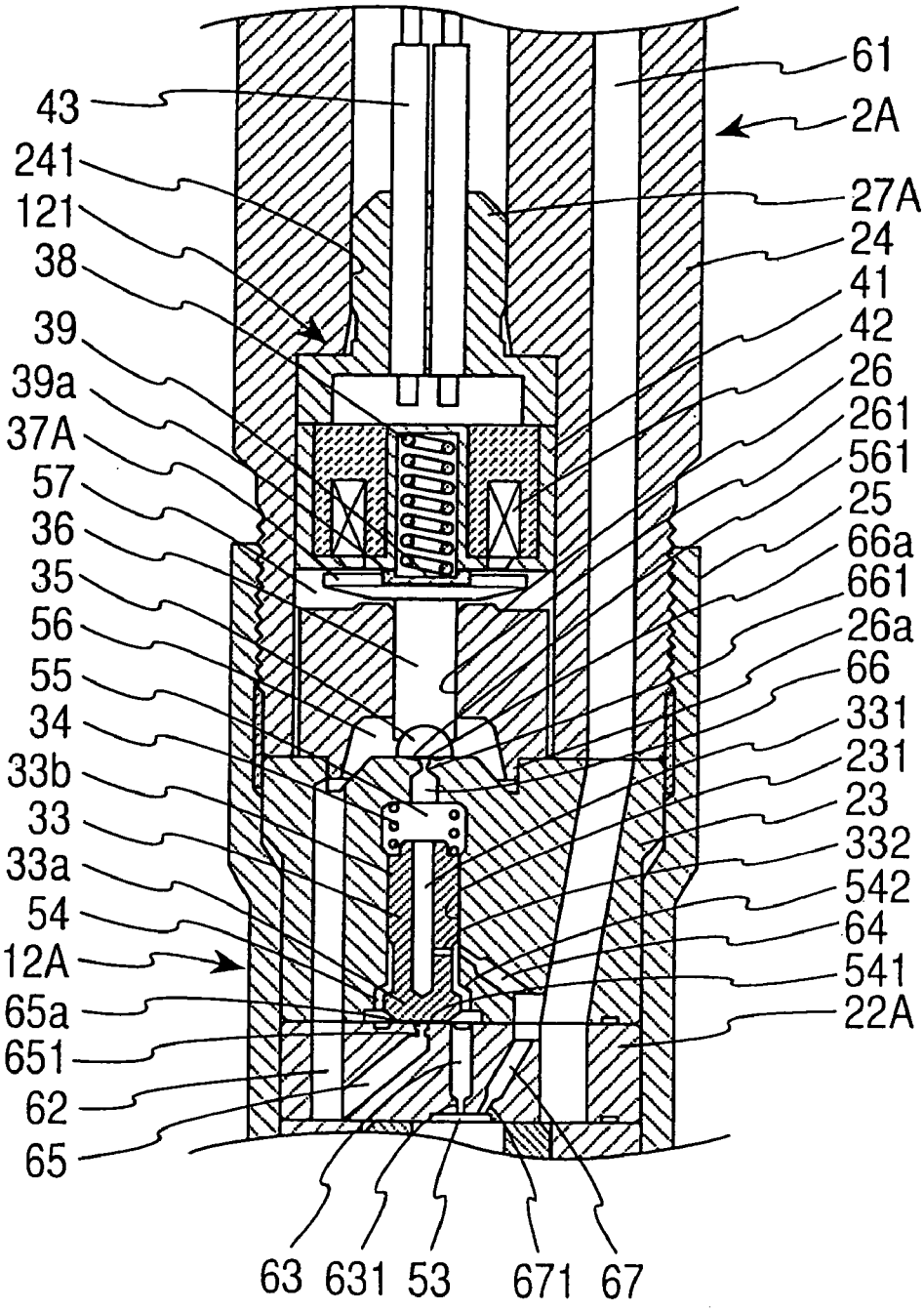
FIG. 8 is an enlarged partial cross sectional view of an injector according to a second embodiment of the present invention.

FIG. 8 shows an injector according to a second embodiment of the present invention. In this embodiment, a portion of the structure of the injector of the first embodiment is changed, and the components similar to those of the first embodiment will be indicated by the same numerals. In the following description, the portion of the structure of the injector, which is different from that of the first embodiment, will be mainly described.

The base body 2A of the second embodiment is basically the same as that of the first embodiment. However, a distance piece 22*a* and a closing member 27A of the second embodiment are different from the distance piece 22 and the closing member 27 of the first embodiment. A high pressure branch passage 67, which branches from the high pressure passage 61 and is communicated to the needle back pressure chamber 53, is formed in the distance piece 22A to always communicate between the needle back pressure chamber 53 and the high pressure passage 61. An orifice (a choke) 671 is formed in the high pressure branch passage 67. In this way, as shown in FIG. 3, at the time of valve opening of the nozzle needle 31, even when the first valve needle 33 is lifted from the lower seat 541 and is seated against the upper seat 542, a predetermined amount of high pressure fuel is supplied to the nozzle needle back pressure chamber 53 through the high pressure branch passage 67. Thus, the valve opening of the nozzle needle 31 is performed at the moderate speed. In contrast, when the first valve needle 33 is lifted from the upper seat 542 and is seated against the lower seat 541, the pressure of the nozzle needle back pressure chamber 53 is rapidly increased due to the inflow of the fuel from the high pressure branch passage 67 in comparison to that of the first embodiment. Thus, the nozzle needle 31 is rapidly seated. Due to the moderate valve opening of the nozzle needle 31, the amount of NOx in the exhaust gas is reduced. Also, due to the rapid valve closing of the nozzle needle 31, the amount of soot in the exhaust gas is reduced. The valve opening speed and the valve closing speed of the nozzle needle 31 can be adjusted by the passage cross sectional area of the orifice 671 of the communication passage 67.

The structure of the armature 37A is basically the same as that of the first embodiment. A spacer 39 is provided in an opposed surface of the armature 37A, which is opposed to the stator 41. The spacer 39 is a circular disk member, which has a diameter larger than that of the coil spring 38. An annular protrusion 39*a* is formed in an outer peripheral edge of the spacer 39. In a state where an upper surface of the annular protrusion 39*a* is engaged with the stator 41, the second valve needle 36 is placed in a fully lifted state. By changing the setting of the height of the protrusion 39*a*, an air gap between the armature 37A and the stator 41 in the fully lifted state of the second valve needle 36 is adjusted.

The seal member of the closing member 27 of the first embodiment is eliminated from the closing member 27A of the second embodiment. In the second embodiment, the closing member 27A is press fitted into the longitudinal hole 241 to seal between the closing member 27A and the longitudinal hole 241, so that the number of the components is reduced.

Third Embodiment

Figure 9:
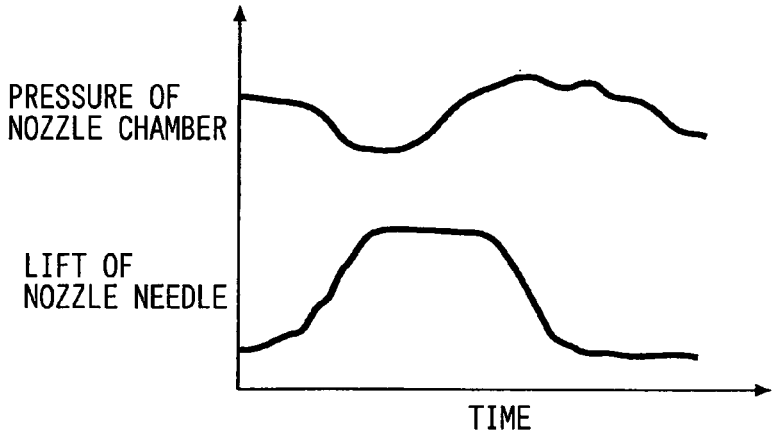
FIG. 9 is a timing chart showing operational characteristics of the first embodiment, illustrating a technical background of a third embodiment of the present invention.
Figure 10:
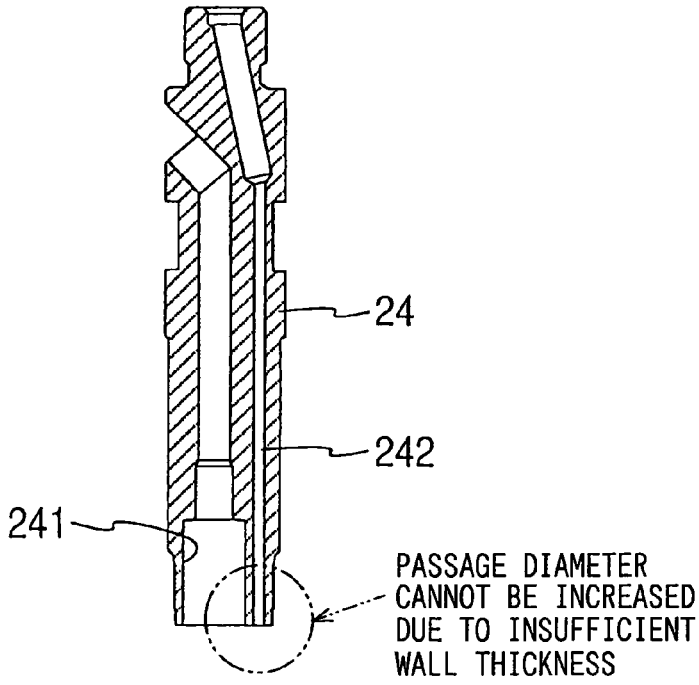
FIG. 10 is a schematic diagram showing a portion of the injector of the first embodiment, illustrating a technical background of the third embodiment.

FIG. 9 is a diagram indicating the lift amount of the nozzle needle 31 and the pressure of the nozzle chamber 51 in the injector of the first embodiment with respect to the fuel injection time period. After the starting of the fuel injection, the pressure of the nozzle chamber 51 is reduced (the pressure drop). It is effective to provide an accumulator chamber in the high pressure passage to limit such a drop in the pressure. For example, as shown in FIG. 10, in the injector of the first embodiment, the inner diameter of a longitudinal hole 242, which is provided to form the high pressure passage 61, may be enlarged for a predetermined depth from the opposed end surface, which is opposed to the first valve body 23 of the holder 24. With this structure, the wall of the holder 24 is substantially thinned at the outer peripheral part of the longitudinal hole 241 to provide the space for the second valve needle 36 and the solenoid 121. Furthermore, as one possible example, the holder may be divided into sub-parts in the axial direction of the injector to form the accumulator chamber, and the sub-parts may be mechanically connected to each other through a retaining nut. However, in such a case, the structure becomes more complicated, and the outer diameter of the injector may be disadvantageously increased. The present embodiment addresses the above disadvantage and promotes the practical use of the injector.

Figure 11:
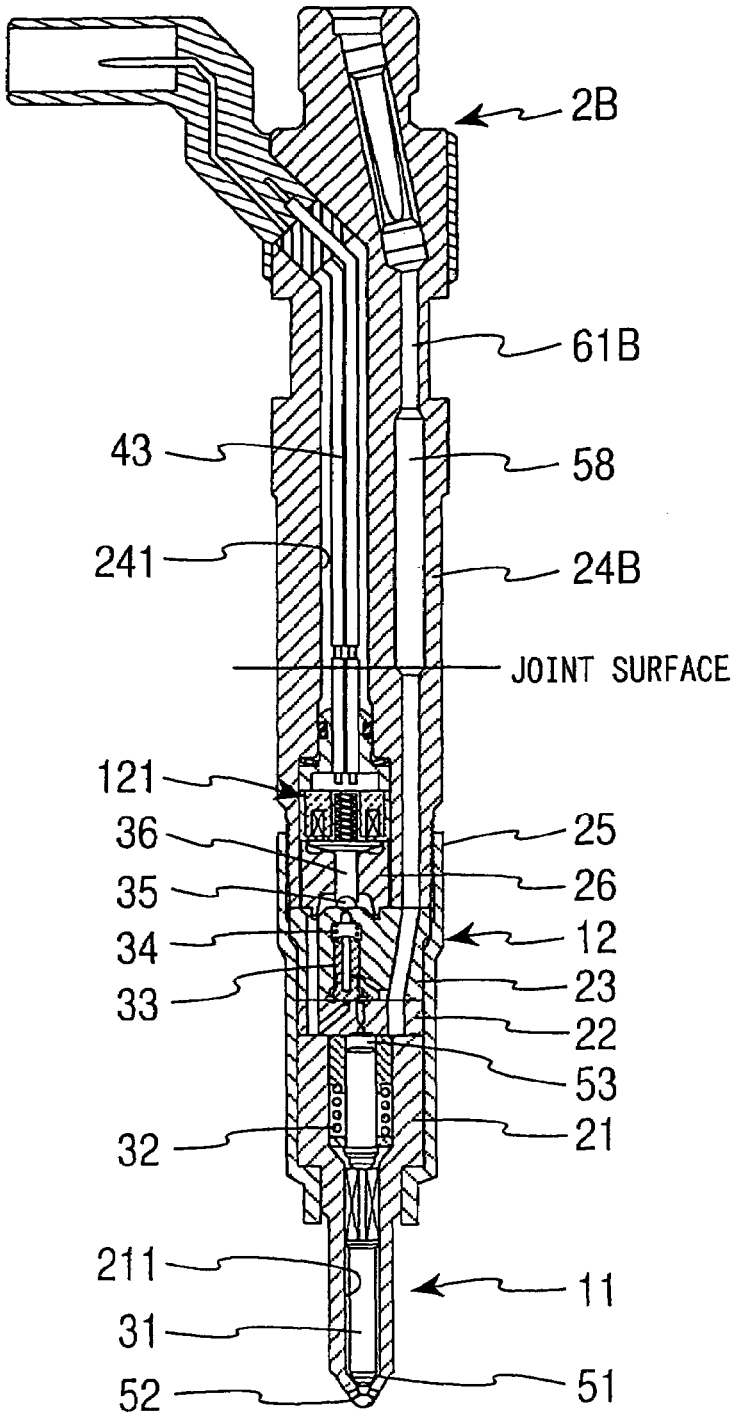
FIG. 11 is a cross sectional view of an injector according to the third embodiment of the present invention.

FIG. 11 shows the injector according to the third embodiment. In this embodiment, a portion of the structure of the injector of the first embodiment is changed, and the components similar to those of the first embodiment will be indicated by the same numerals. In the following description, the portion of the structure of the injector, which is different from that of the first embodiment, will be mainly described.

The high pressure passage 61B, which is formed in the base body 2B, is basically the same as the high pressure passage 61 of the first embodiment. The only difference from the first embodiment is that an accumulator chamber 58 is provided in the high pressure passage 61B. The accumulator chamber 58 is arranged on the lateral side of the longitudinal hole 241 at the location where the small diameter portion for receiving the lead lines 43 of the longitudinal hole 241 is provided. In this way, the sufficient outer peripheral wall thickness of the accumulator chamber 58 can be maintained.

Figure 12:
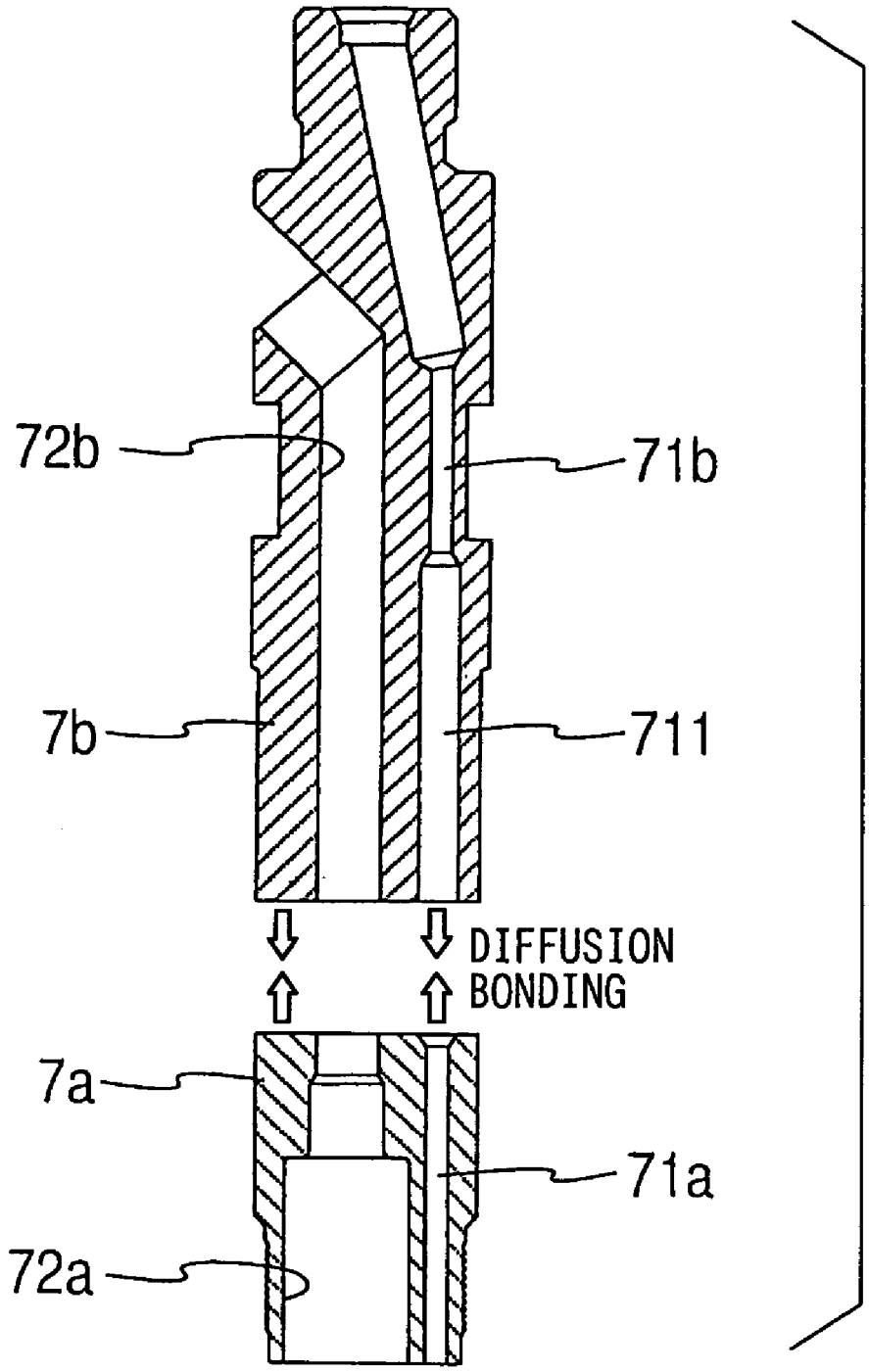
FIG. 12 is a schematic cross sectional view showing a manufacturing process of the injector of the third embodiment.

The accumulator chamber 58 is formed in the following manner. In the present embodiment, as shown in FIG. 12, two members (a distal end part and a base end part) 7*a*, 7*b* are provided at the time of forming the holder 24B. The members 7*a*, 7*b* have the corresponding shapes, which are made upon dividing the holder 24B of the injector into the two parts in the axial direction of the injector along an imaginary line that transversely crosses the accumulator chamber 58. Each of the members 7*a*, 7*b* has a hole 71*a*, 71*b*, which forms a part of the high pressure passage 61B, and a hole 72*a*, 72*b*, which forms a part of the longitudinal hole 241 upon receiving the second valve body 26. In the member 7*b*, which forms the upper part of the holder 24B, the hole 71*b*, which forms the high pressure passage 61B, has an enlarged diameter portion (an enlarged cross sectional portion) that has an enlarged inner diameter (an enlarged cross sectional area) and is formed for the predetermined depth from the engaging end surface (a joint end surface or a joint surface) of the member 7*b*, which engages the other member 7*a*.The engaging end surfaces of the members 7*a*, 7*b* are cleaned and are engaged with each other. Then, the engaging end surfaces of the members 7*a*, 7*b* are heated to the high temperature. The atoms of the members 7*a*, 7*b* are diffused in a corresponding range, which is centered in the opposed end surfaces of the members 7*a*, 7*b*, so that the members 7*a*, 7*b* are joined together by diffusion bonding. The enlarged diameter portion 711 of the hole 71*b* forms the accumulator chamber 58.

In this way, the accumulator chamber 58 can be formed without thinning the wall of the base body 2B at the outer peripheral part of the accumulator chamber 58. Furthermore, the members 7*a*, 7*b* are not mechanically joined in the present embodiment, so that the size of the injector is not substantially increased.

Fourth Embodiment

Figure 13:
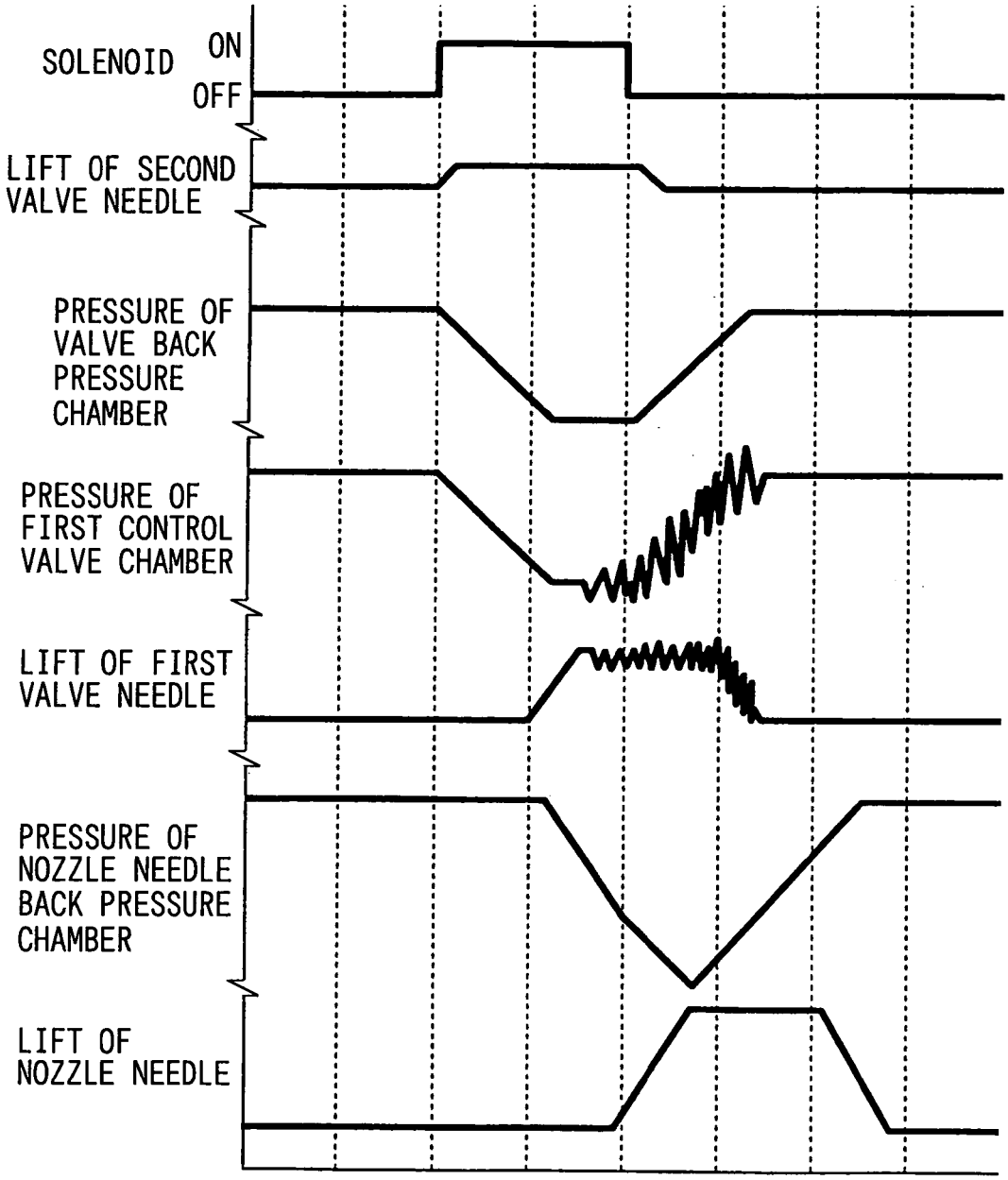
FIG. 13 is a timing chart illustrating a technical background of a fourth embodiment.

Influences of the pressure of the first control valve chamber 54 against the lifting of the first valve needle 33 will be described with reference to FIG. 13. As described with reference to FIG. 3, when the pressure of the valve back pressure chamber 55 located on the upper side of the first valve needle 33 is reduced, the first valve needle 33 is lifted from the lower seat 541 and is seated against the upper seat 542. At this time, as shown in FIG. 13, the pressure of the first control valve chamber 54, which is exerted in the lifting direction of the first valve needle 33, is not stabilized to cause vibrations of the first valve needle 33. For example, in the injector of the first embodiment, the pressure of the first control valve chamber 54 is kept relatively high due to the presence of the orifice 651, which is arranged directly below the port 65*a* to be opened. However, when the force induced by the pressure of the valve back pressure chamber 55 (and additionally the spring force of the coil spring 34) becomes higher than the force induced by the pressure of the first control valve chamber 54, the first valve needle 33 is lifted from the upper seat 542. Since the upper seat 542 has the large opening area, the high pressure fuel flows from the high pressure passage 61, the high pressure branch passage 64 and the first control valve chamber 54. Thus, the pressure of the first control valve chamber 54 is increased. Due to this pressure increase, the first valve needle 33 is moved upward once again to close the upper seat 542.

When this phenomenon is repeated, it may cause vibrations of the first valve needle 33, which in turn causes variations in the amount of fuel injection, or which in turn causes wearing of the valve seats. The present embodiment addresses the above disadvantage and promotes the practical use of the injector.

Figure 14:
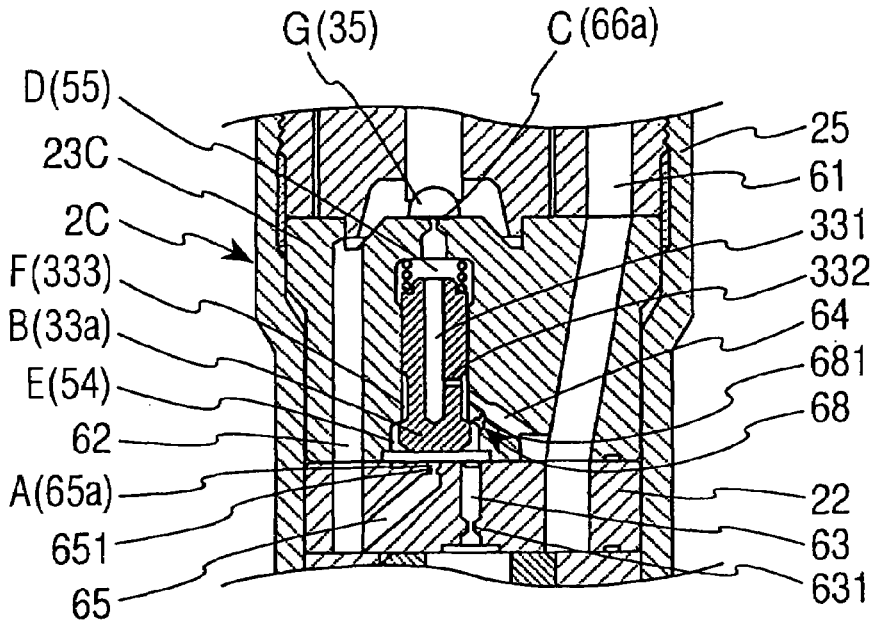
FIG. 14 is an enlarged partial cross sectional view of an injector according to the fourth embodiment.

FIG. 14 shows the injector according to the present embodiment. In this embodiment, a portion of the structure of the injector of the first embodiment is changed, and the components similar to those of the first embodiment will be indicated by the same numerals. In the following description, the portion of the structure of the injector, which is different from that of the first embodiment, will be mainly described.

The base body 2C of this embodiment is basically the same as that of the first embodiment. However, the first valve body 23C, which forms the base body 2C, is different from that of the first embodiment. In the first valve body 23C, the high pressure branch passage 64, which extends from the high pressure passage 61, is branched at the point that is on the upstream side of the opening of the high pressure branch passage 64 to the outer peripheral annular space 333 located at the neck of the first valve needle 33. This branched part of the high pressure branch passage 64 is opened in the inner peripheral wall of the first control valve chamber 54 to form a continuously connected passage 68, which always communicates between the high pressure passage 64 and the first control valve chamber 54. The continuously connected passage 68 forms the communication passage, which directly communicates between the high pressure branch passage 64 and the first control valve chamber 54 without passing through the outer peripheral annular space 333. Furthermore, an orifice (a choke) 681 is provided in the continuously connected passage 68. In this way, even when the first valve needle 33 is seated against the upper seat 542, the small amount of high pressure fuel is supplied to the first control valve chamber 54 upon being restricted by the orifice 681. Thus, the pressure of the first control valve chamber 54 does not decrease excessively, and therefore it is possible to limit fluctuations of the seating position of the first valve needle 33.

Figure 15:
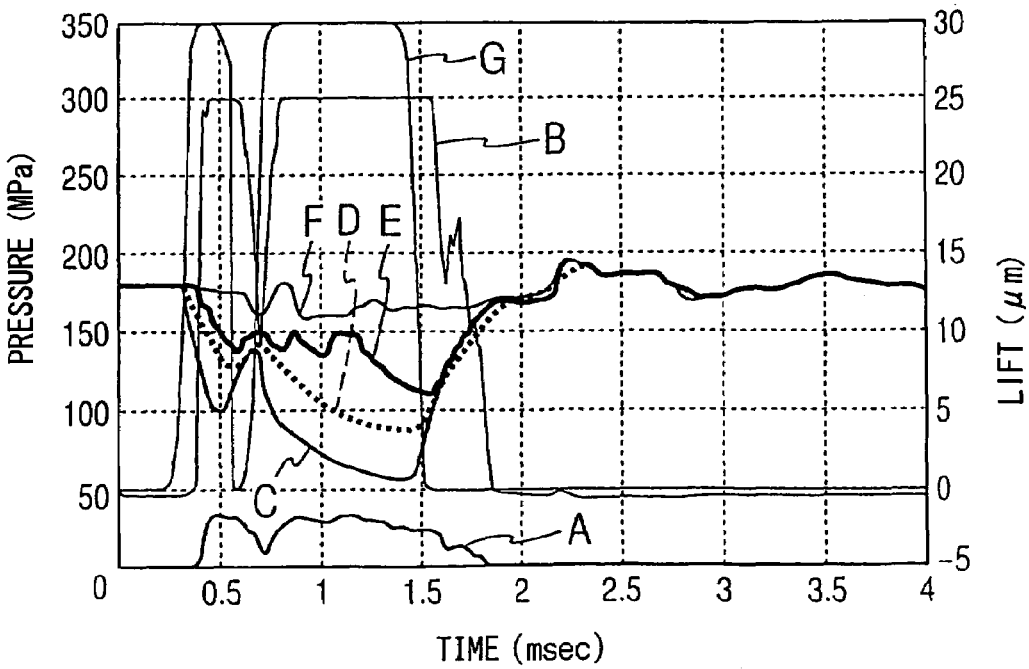
FIG. 15 is a diagram showing a result of an operational simulation, indicating an advantage of a continuously connected passage of the fourth embodiment.
Figure 16:
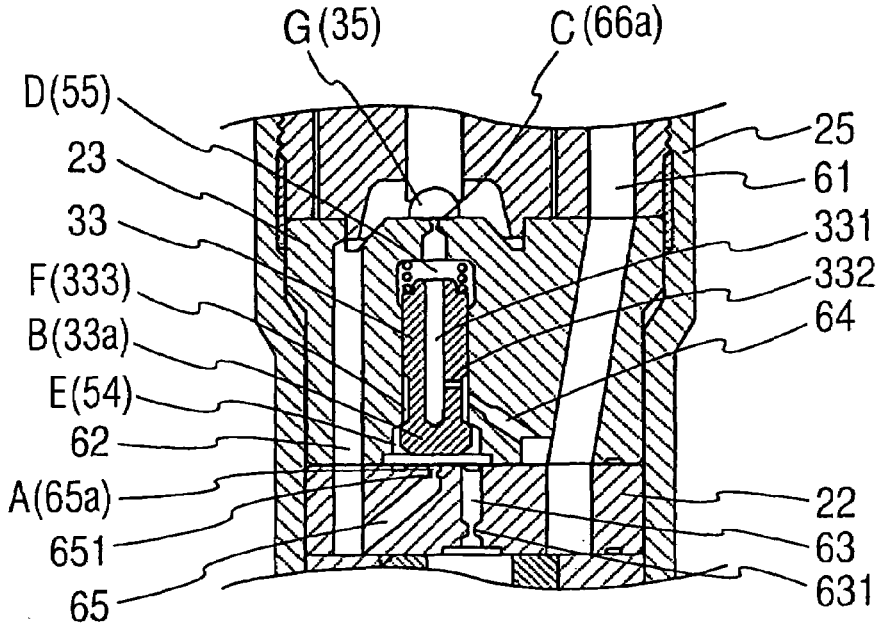
FIG. 16 is an enlarged partial cross sectional view of the injector of the first embodiment, having no continuously connected passage of the fourth embodiment.
Figure 17:
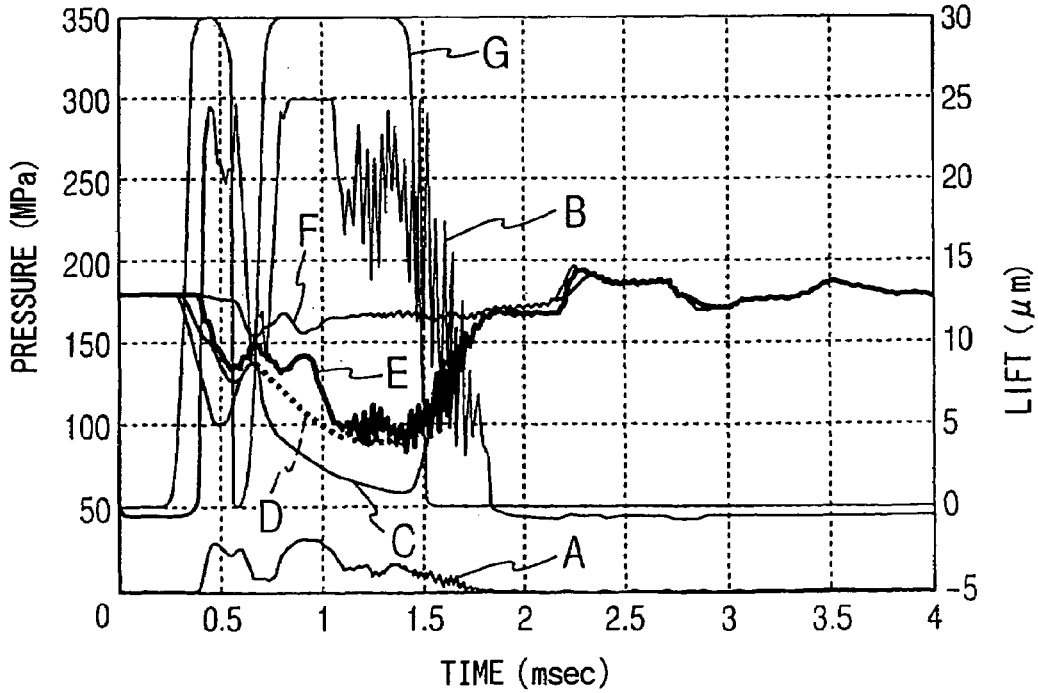
FIG. 17 is a diagram showing a result of an operational simulation of the injector of FIG. 16.

FIG. 15 shows the advantages of the continuously connected passage 68 of the present embodiment, which are confirmed through the simulation of the operation of the injector. The waveforms, which are indicated by A-F in FIG. 15, are measured at the corresponding points A-F in FIG. 14. For comparative purposes, FIG. 17 shows the result of another simulation, which is performed under the same conditions on the structure of FIG. 16 (the structure of the first embodiment) that is not provided with the continuously connected passage 68. In each of FIGS. 15 and 17, the pressure of each corresponding part of the injector is indicated by a first axis of ordinates located on the left side of the figure. Also, in each of FIGS. 15 and 17, the lift amount of each corresponding component of the injector is indicated by a second axis of ordinates located on the right side of the figure. In each of FIGS. 15 and 17, the line E indicates the pressure of the fist control valve chamber 54, which is exerted in the upward direction against the first valve needle 33. Also, in each of FIGS. 15 and 17, the line D indicates the pressure of the valve back pressure chamber 55, which is exerted in the downward direction against the first valve needle 33. In the case of FIG. 17, when the line D and the line E are close to each other, the pressure (the line E) of the first control valve chamber 54 repeats the increase and decrease, and the movement (line B) of the valve needle 33 becomes oscillatory movement. In contrast, in FIG. 15, the movement (the line B) of the valve needle 33 is stabilized in comparison to that of FIG. 17, and the fluctuations of the pressure (the line E) of the first control valve chamber 54 are limited by the continuously connected passage 68. As a result, it is possible to limit the variations in the fuel injection and also the wearing of the valve seats caused by the vibrations.

Fifth and Sixth Embodiments

Figure 18:
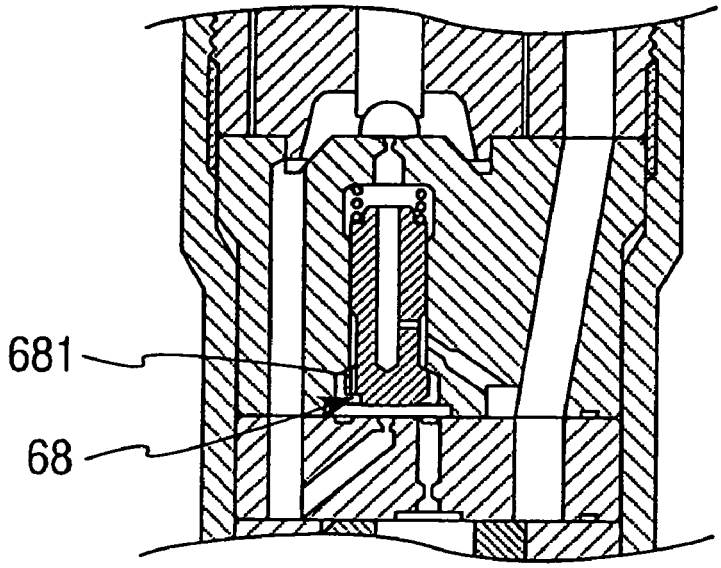
FIG. 18 is an enlarged partial cross sectional view of an injector according to a fifth embodiment of the present invention.
Figure 19:
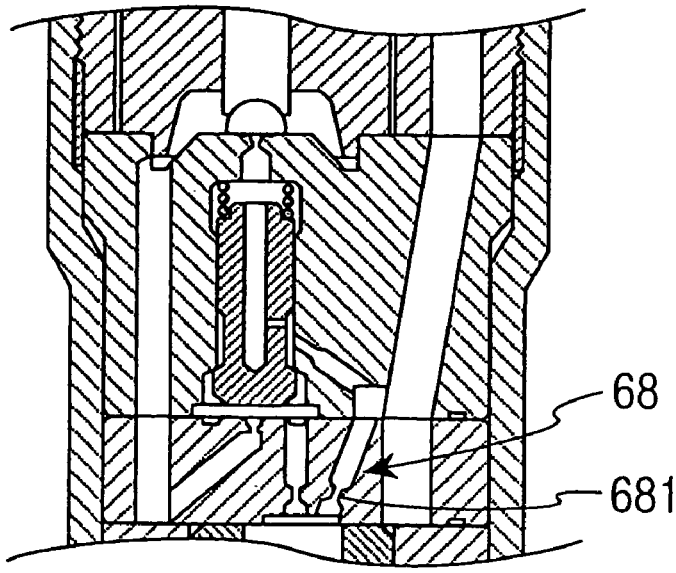
FIG. 19 is an enlarged partial cross sectional view of an injector according to a sixth embodiment of the present invention.

The position of the continuously connected passage 68 is not limited to that of the fourth embodiment and can be changed to any other suitable position, which communicates between the first control valve chamber 54 and the high pressure passage 61. In the fifth embodiment of FIG. 18, the continuously connected passage 68 is provided in the valve body 33*a* of the first valve needle 33 to directly communicate between the outer peripheral annular space 333 and the first control valve chamber 54. The first control valve chamber 54 receives the predetermined amount of high pressure fuel from the outer peripheral annular space 333, which is always communicated with the high pressure passage 61 by the high pressure branch passage 64, through the orifice 681 provided in the continuously connected passage 68. In the sixth embodiment of FIG. 19, the continuously connected passage 68 is communicated with the high pressure branch passage 64 and the nozzle needle back pressure chamber 53. With this structure, the nozzle needle back pressure chamber 53 is connected to the first control valve chamber 54 through the orifice 631, which is provided in the communication passage 63.

Even in the fifth and sixth embodiments, similar to the fourth embodiment, the fluctuations in the pressure of the first control valve chamber 54 can be limited to limit vibrations of the first valve needle 33. In the sixth embodiment, the structure is substantially similar to that of the second embodiment. Through the adjustment of the valve opening and closing speeds of the first valve needle 33, the reduction in the exhaust gas emission can be achieved simultaneously with the increase in the lifetime of the injector through the reduction in variations of the fuel injection and the limitation of the wearing of the valve seats. The inner diameter of the orifice 681, which is provided in the continuously connected passage 68 of the fourth to sixth embodiments, is determined in connection with the inner diameter of the orifice 651, which is provided on the downstream side of the port 65*a* to communicate between the first control valve chamber 54 and the low pressure branch passage 65. In the sixth embodiment, the inner diameter of the orifice 681 is determined also in connection with the inner diameter of the orifice 631, which is provided in the communication passage 63 connected to the nozzle needle back pressure chamber 53.

Seventh Embodiment

Figure 20:
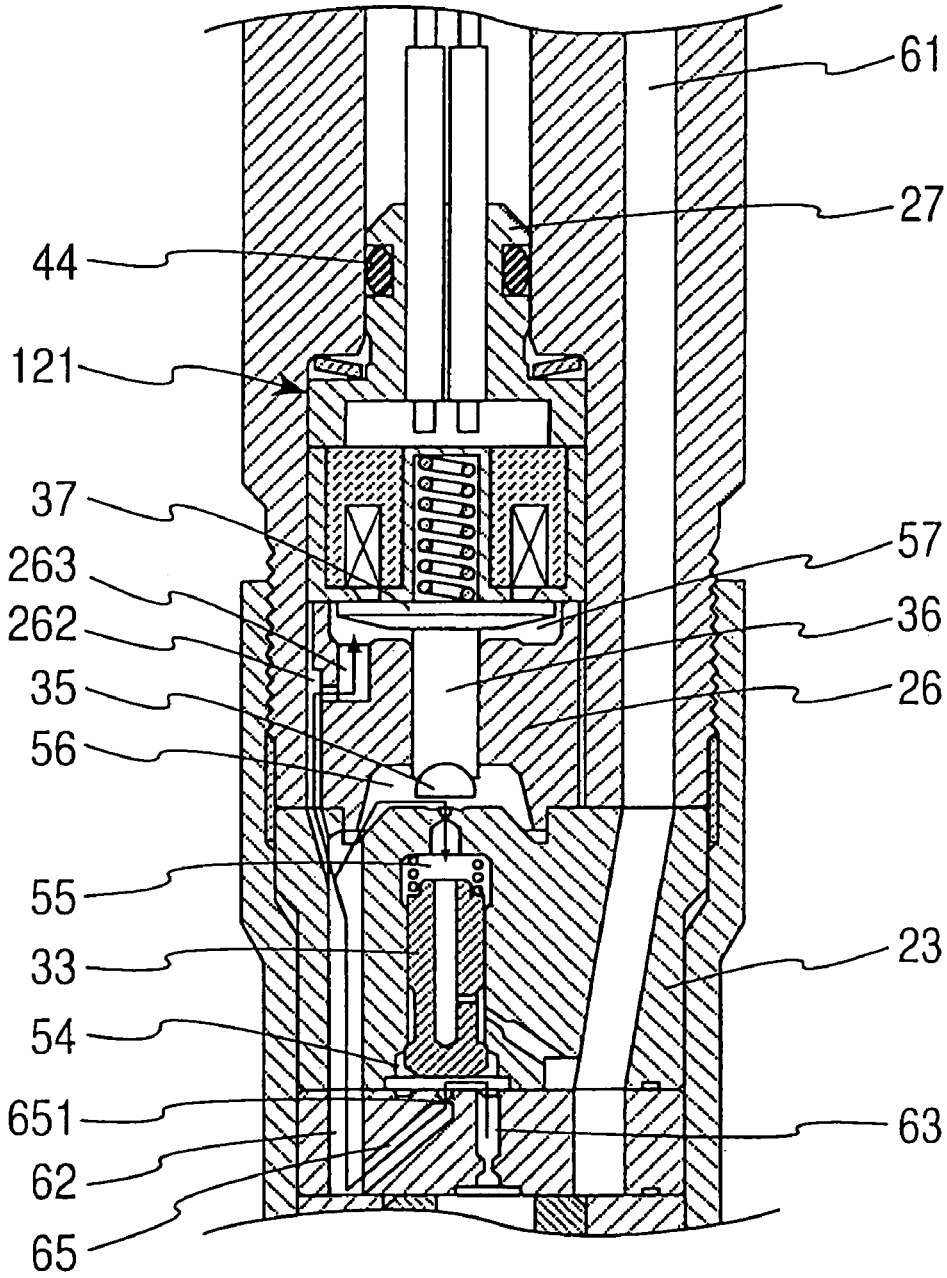
FIG. 20 is an enlarged partial cross sectional view of an exemplary comparative injector.

Switching leakage of the control valve will be described with reference to FIG. 20. In the above embodiment, the leaked fuel is supplied from the second control valve chamber 56 to the solenoid chamber 57, in which the armature 37 is received, through the sliding space of the second valve needle 36. A leakage recovery passage is provided to continuously communicate between the solenoid chamber 57 and the low pressure passage 62 to limit development of the high pressure in the solenoid chamber 57 caused by accumulation of the leaked fuel in the solenoid chamber 57. For example, a low pressure passage 262, which is connected to the low pressure passage 62 at the upper end of the first valve body 23, is provided in the outer peripheral part of the second valve body 26. The low pressure passage 262 is communicated with the solenoid chamber 57 through a low pressure passage 263, which is provided in the second valve body 26, to recover the leaked fuel from the solenoid chamber 57. With this structure, when the armature 37 is attracted to the solenoid 121, the second valve needle 36 is lifted together with the armature 37. Thus, the fuel of the back pressure chamber 55 leaks first, and then the first valve needle 33 is lifted upon lapse of relatively short time from the time of lifting the second valve needle 36. As a result, the fuel in the nozzle needle back pressure chamber 53 located below the first valve needle 33 is leaked through the communication passage 63 (hereinafter, this leakage of fuel at the time of valve opening will be referred to as "the switching leakage").

The time difference between the lifting of the armature 37 and the lifting of the first valve needle 33 is very small, so that the fuel of the valve back pressure chamber 55 and the fuel of the nozzle needle back pressure chamber 53 are substantially simultaneously supplied to the solenoid chamber 57 (see the arrow in the drawing). Thus, the pressure surge is generated in the solenoid chamber 57, and the hydraulic pressure, which is applied to the armature 37, varies. When the valve closing speed of the valve body 33*a*, which is provided in the lower end of the first valve needle 33, varies due to the variation of the hydraulic pressure applied to the armature 37, the amount of fuel injection may be varied. Particularly, in the case of pilot injections for injecting fuels several times within a short time period, there is a substantial influence. For example, the surge of the switching leakage caused by the previous injection may cause a change in the valve opening speed in the next injection. The present embodiment addresses the above disadvantage and promotes the practical use of the injector.

Figure 21:
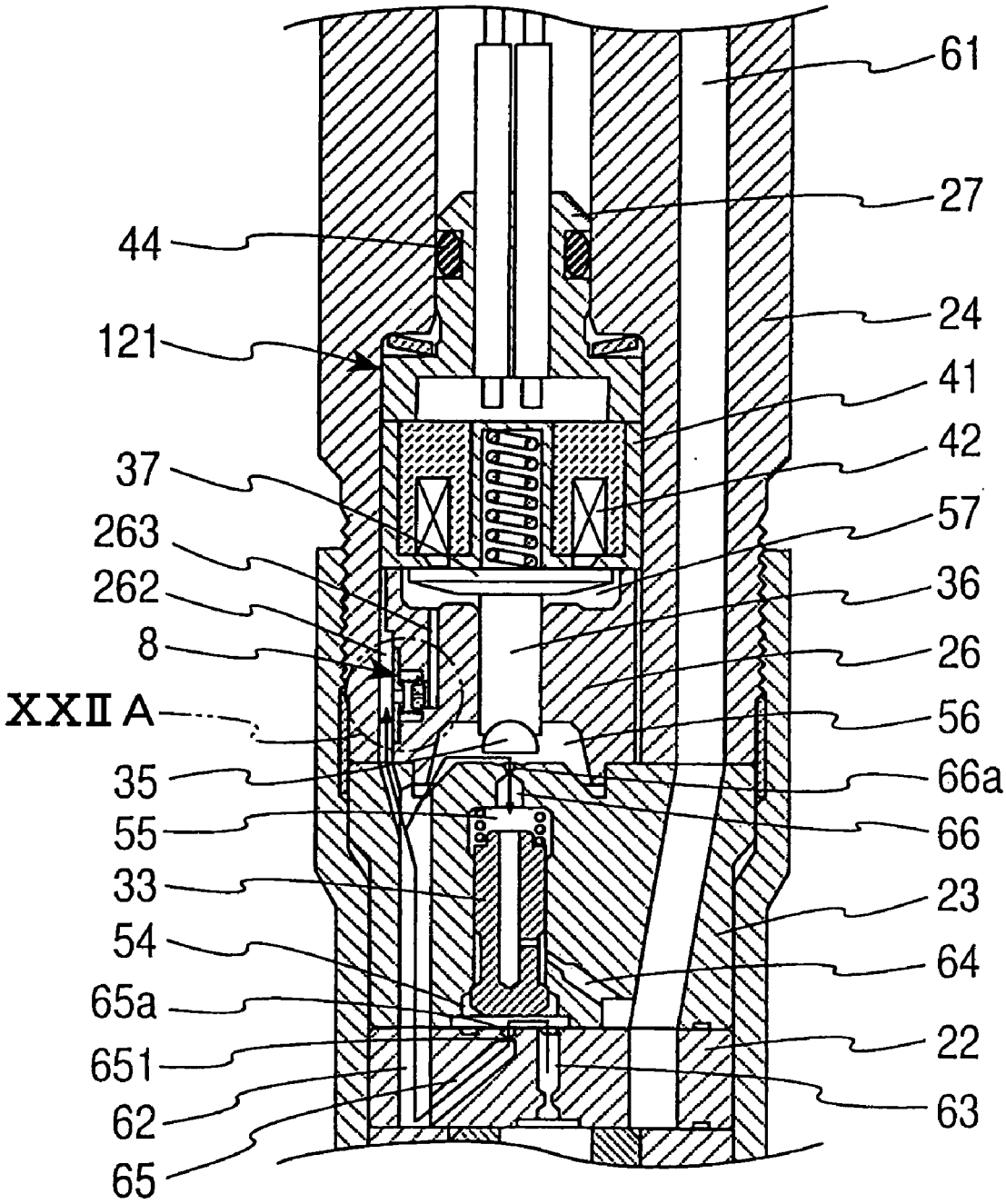
FIG. 21 is an enlarged partial cross sectional view of an injector according to a seventh embodiment of the present invention.

FIG. 21 shows the injector according to the seventh embodiment. In this embodiment, a portion of the structure of the injector of the first embodiment is changed, and the components similar to those of the first embodiment will be indicated by the same numerals. In the following description, the portion of the structure of the injector, which is different from that of the first embodiment, will be mainly described.

Figure 22A:
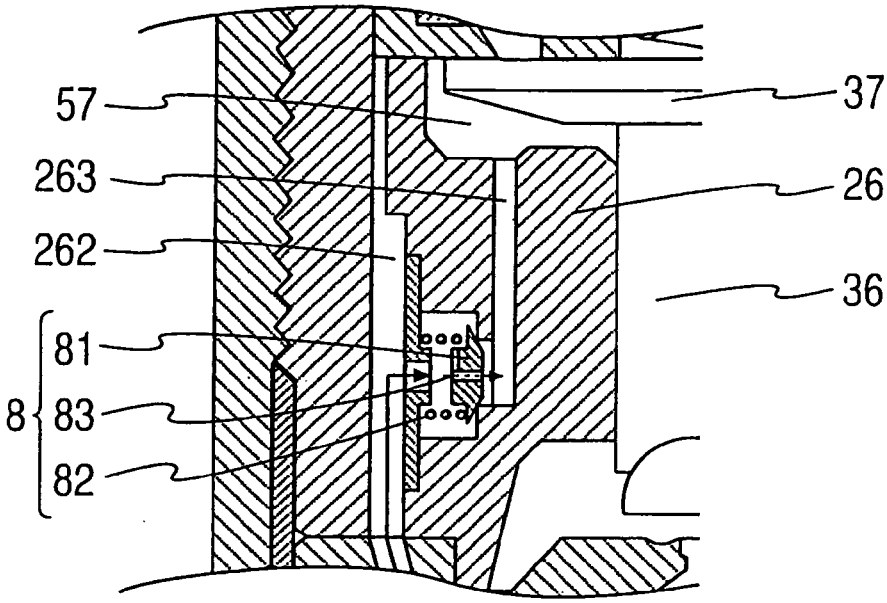
FIG. 22A is an enlarged view showing an encircled portion XXIIA in FIG. 21, illustrating a closed state of a check valve of the injector.

In the outer peripheral part of the second valve body 26, there is provided the low pressure passage 262, which is communicated with the low pressure passage 62 at the upper end of the first valve body 23. In the second valve body 26, one end of the low pressure passage 263 is opened in the bottom wall of the solenoid chamber 57, and the other end of the low pressure passage 263 is opened in the outer peripheral surface of the second valve body 26 to communicate with the low pressure passage 262. A check valve 8 is provided in a connecting end of the low pressure passage 263, which is connected to the low pressure passage 262. The check valve 8 permits the fuel flow only from the solenoid chamber 57 toward the low pressure passage 62. As shown in FIG. 22A, the check valve 8 includes a valve body 81 and a spring 82. The valve body 81 opens and closes the low pressure passage 263. The spring 82 is arranged radially outward of the valve body 81 to urge the valve body 81 against the step, which is provided in the low pressure passage 263. A spring force of the spring 82 is set to be a relatively low value to permit valve opening of the valve body 81 at a predetermined low pressure. An orifice 83 is formed in the valve body 81 to continuously communicate between the low pressure passage 262 and the low pressure passage 263.

With this structure, when the switching leakage occurs, the fuel of the valve back pressure chamber 55 and the fuel of the nozzle needle back pressure chamber 53 are substantially simultaneously supplied to the low pressure passage 262. However, due to the presence of the check valve 8, only the small amount of fuel, which has passed the orifice 83, is supplied to the low pressure passage 263 (see the arrow in the drawing). Thus, the substantial pressure surge does not occur in the solenoid chamber 57, and therefore it is possible to limit a change in the valve closing speed caused by a change in the hydraulic pressure applied to the armature 37. Therefore, even in the case of the pilot injections for injecting fuel several times within the short time period, it is possible to limit occurrence of variations in the amount of fuel injection. As a result, the fuel injection controllability is improved.

Figure 22B:
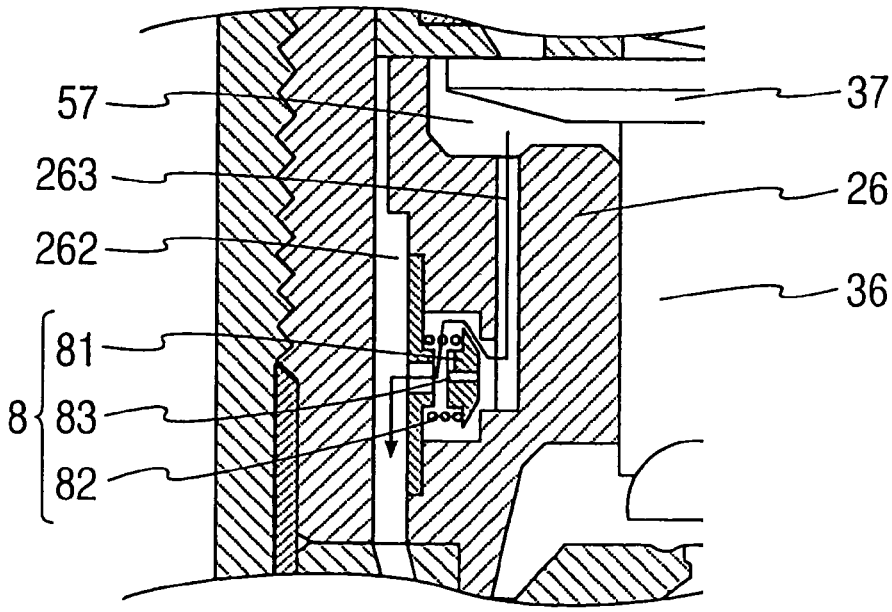
FIG. 22B is a view similar to FIG. 22B, illustrating an opened state of the check valve of the injector.

In contrast, as shown in FIG. 22B, when the pressure of the solenoid chamber 57 is increased by the leaked fuel, the valve body 81 is opened against the urging force of the spring 82 to release the pressure from the solenoid chamber 57. The opening and closing of the valve body 81 cause effluence of the fuel, so that the pressure surge, which occurs at the time of lifting of the armature 37, can be limited. Furthermore, the inflow of the leaked fuel from the high pressure part to the low pressure part is reduced, so that the temperature increase of the solenoid chamber 57 can be limited. In this way, thermal deformation of the components is reduced, and thereby the components can be made of a material, which has a relatively low heat resistant temperature.

The orifice 83 is provided to remove air from the solenoid chamber 57 after the assembly of the injector. In this case, since the leakage from the sliding components is relatively small, the air can be removed from the solenoid chamber 57 through the orifice 83 by supplying fuel through the low pressure passages 262, 263. However, in the case where the removal of the air is not necessary, the orifice 83 may be eliminated.

Eighth Embodiment

Figure 23A:
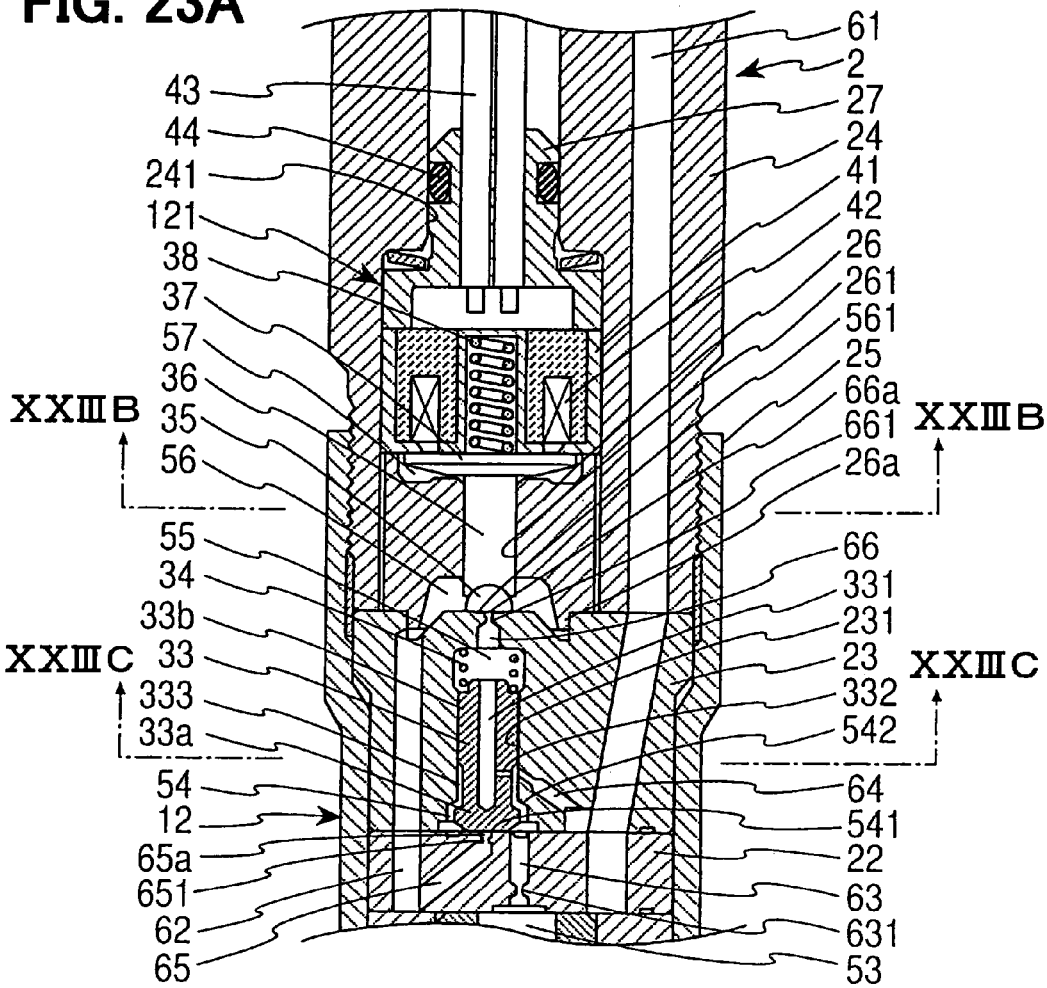
FIG. 23A is an enlarged partial cross sectional view of an injector according to an eighth embodiment of the present invention.
Figure 23B:
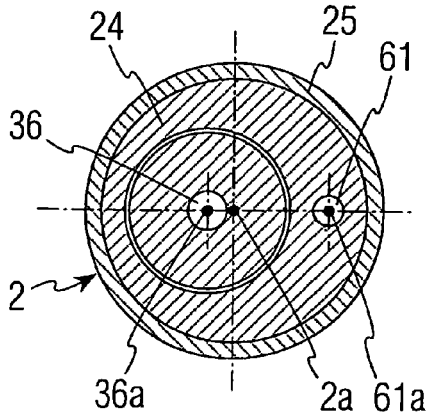
FIG. 23B is a cross sectional view along line XXIIIB-XXIIIB in FIG. 23A.
Figure 23C:
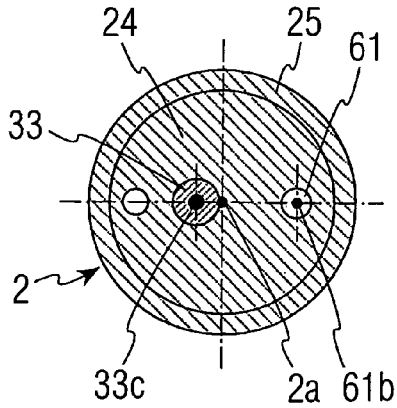
FIG. 23C is a cross sectional view along line XXIIIC-XXIIIC in FIG. 23A.

Preferred position and arrangement of each main component of the above respective embodiments will be described with reference to FIGS. 23-25. FIG. 23A is the same as FIG. 2. FIG. 23B is a cross sectional view taken along line XXIIIB in FIG. 23A, and FIG. 23C is a cross sectional view taken along line XXIIIC-XXIIIC in FIG. 23A. FIG. 23B shows the position of the high pressure passage 61 and the position of the second valve needle 36. As shown in FIG. 23B, a center point 61*a* of the high pressure passage 61 and a center point 36*a* of the second valve needle 36 are arranged along an imaginary line (a horizontal dot-dash line extending in the left-right direction in FIG. 23B), which passes through a center point 2*a* of the base body 2. Furthermore, the high pressure passage 61 and the second valve needle 36 are not overlapped with each other. More specifically, the high pressure passage 61 and the second valve needle 36 are diametrically opposed to each other about the center point 2*a*.

When the second valve needle 36 is arranged to be eccentric to the center point 2*a* of the base body 2, the space, which is provided radially outward of the high pressure passage 61, can be maximized. That is, since the high pressure fluid passes through the high pressure passage 61, the passage wall of the high pressure passage 61 needs to have the sufficient thickness to achieve the sufficient strength. With the structure shown in FIG. 23B, the relatively large space can be provided around the high pressure passage 61 to allow the provision of the sufficient wall thickness of the high pressure passage 61 for achieving the sufficient strength.

FIG. 23C shows the position of the high pressure passage 61 and the position of the first valve needle 33. As shown in FIG. 23C, a center point 61*b* of the high pressure passage 61 and a center point 33*c* of the first valve needle 33 are arranged along an imaginary line (a horizontal dot-dash line extending in the left-right direction in FIG. 23C), which passes through a center point 2*b* of the base body 2. Furthermore, the high pressure passage 61 and the first valve needle 33 are not overlapped with each other. More specifically, the high pressure passage 61 and the first valve needle 33 are diametrically opposed to each other about the center point 2*b*.

Similar to FIG. 23B, the space, which is provided radially outward of the high pressure passage 61, can be maximized. Thus, the large space is provided around the high pressure passage 61 that conducts the high pressure fluid, and the wall thickness of the high pressure passage 61 can be made sufficiently large to improve the strength of the high pressure passage 61.

The center of the nozzle needle 31 (FIG. 1) and the center of the base body 2 should be coincided with each other. The orifice 661, which is provided in the communication passage 66 between the valve back pressure chamber 55 and the second control valve chamber 56, is preferably set to have an inner diameter (or an effluent flow rate) that is equal to or greater than that of the lateral hole 332, which supplies the high pressure fuel to the valve back pressure chamber 55. That is, it is preferred to satisfy the following condition:

Diameter (Outflow Rate) of Orifice 661≧Diameter (Inflow Rate) of Lateral Hole 332.

In this way, the pressure of the valve back pressure chamber 55 can be reliably decreased at the time of moving the second valve needle 36 in the upward direction through energization of the solenoid 121.

Figure 24:
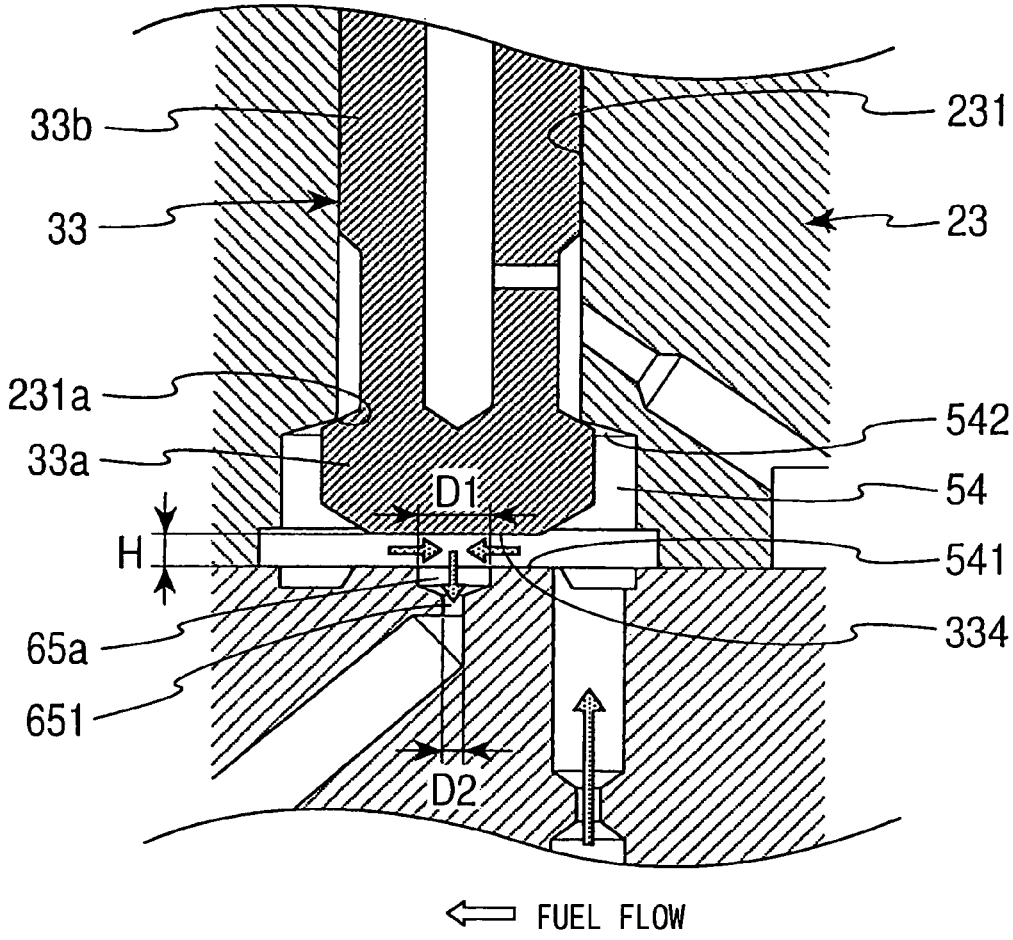
FIG. 24 is an enlarged partial cross sectional view of the injector of the eighth embodiment, illustrating one operational state of a first valve needle of the injector.

As shown in FIG. 24, the diameter of the port 65*a*, which is opened and closed by the first valve needle 33, is denoted by "D1", and the diameter of the orifice 651, which is adjacent to the port 65*a* on the downstream side of the port 65*a*, is denoted by "D2". Furthermore, the height of the first valve needle 33 at the time of the lifting of the first valve needle 33 is denoted by "H". With reference to the above notations, a surface area (π×D1×H), which is defined by the lower end surface 334 of the first valve needle 33 and the port 65*a*, is set to be larger than a cross sectional area (π/4×D2×D2) of the orifice 651.

That is, the following two conditions should be satisfied:

Cross Sectional Area of Orifice 651<Surface Area defined by lower End surface 334 and Port 65*a*; and Diameter D2 of Orifice 651<Diameter D1 of Port 65*a*.

When the first valve needle 33 is lifted from the lower seat 541, fuel flows, as indicated by the arrows in FIG. 24. At this time, when the above settings are implemented, the small gap (lifting height H) between the first valve needle 33 and the port 65*a* becomes greater than the orifice 651, so that the substantial flow resistance, which interferes with the fluid flow, is not created.

Figure 25:
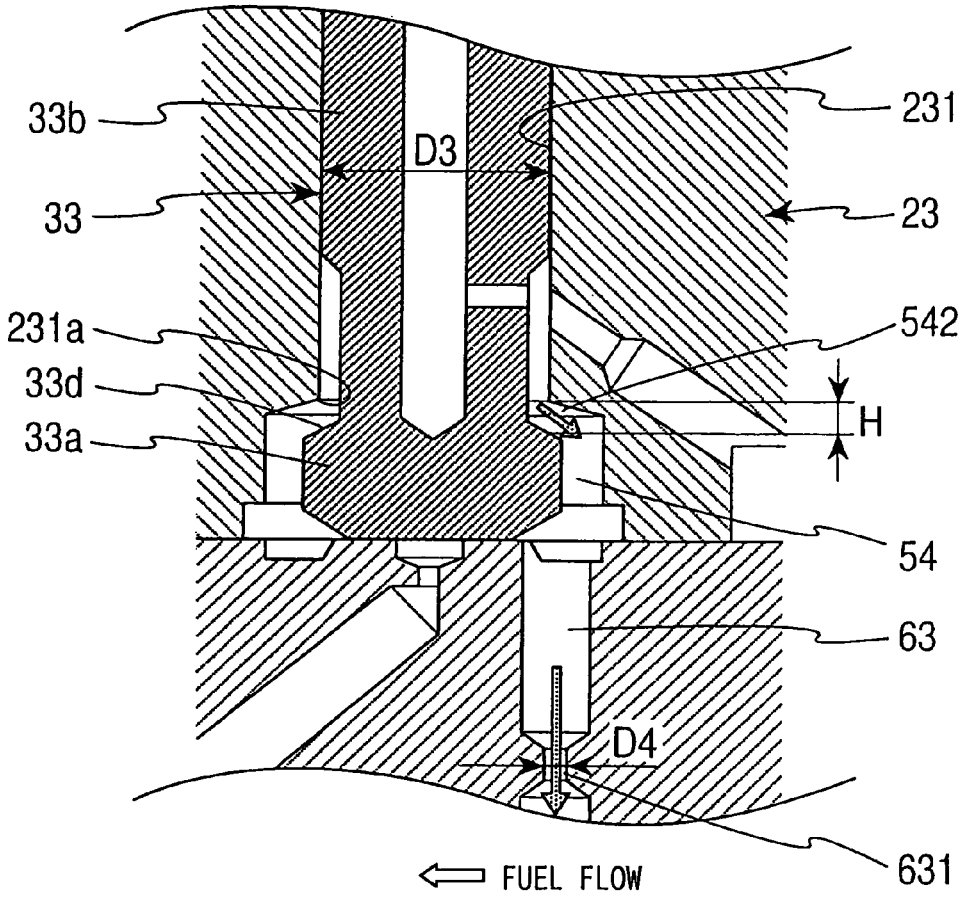
FIG. 25 is a view similar to FIG. 24, illustrating another operational state of the first valve needle of the injector.

As shown in FIG. 25, the outer diameter of the valve body 33*a* of the first valve needle 33 is set to be larger than the diameter D3 of the longitudinal hole 231, in which the shaft portion 33*b* is slid. That is, the following condition should be satisfied:

Outer Diameter of Valve Body 33*a*>Diameter D3 of Longitudinal Hole 231.

The first valve needle 33, which is a movable member, slidably contacts the longitudinal hole 231 of the first valve body 23 through the shaft portion 33*b*.When the above settings are implemented, a tapered surface 33*d* of the valve body 33*a* of the first valve needle 33 is engaged with a lower end corner 231*a* of the longitudinal hole 231. That is, the first valve needle 33 can be limited from lifting by the first valve body 23.

Furthermore, when the diameter of the orifice 631, which is provided in the communication passage 63 connected to the needle back pressure chamber 53, is denoted by D4, the surface area (π×D3×H), which is defined by the corner 231*a* and the tapered surface 33*d*, is set to be larger than the cross sectional area (π/4×D4×D4) of the orifice 631.

When the first valve needle 33 is lifted from the upper seat 542, fuel flows, as indicated by the arrows in FIG. 25. At this time, the orifice 631, which has the minimum cross sectional area, is provided in the communication passage 63, processing of which can be easily controlled in comparison to the flow passage defined by the longitudinal hole 231 and the valve body 33*a*, which require more precise processing. In this way, manufacturing variations can be reduced.

The relationship between the cross sectional area ($\pi/4\times D4\times D4$) of the orifice 631 and the cross sectional area ($\pi/4\times D2\times D2$) of the orifice 651 of FIG. 24 is set as follows:

Cross Sectional Area of Orifice 651<Cross Sectional Area of Orifice 631.

In this way, the pressure increasing speed and the pressure decreasing speed of the nozzle needle back pressure chamber 53 (FIG. 23) can be independently set by the orifice 631 and the orifice 651.

As shown in FIG. 25, the pressure of the nozzle needle back pressure chamber 53 is increased by supplying the high pressure fluid of the high pressure passage 61 to the nozzle needle back pressure chamber 53 through the orifice 631. In contrast, as shown in FIG. 24, at the time of decreasing the pressure of the nozzle needle back pressure chamber 53, the fluid is discharged from the nozzle needle back pressure chamber 53 to the low pressure passage 62 through the orifice 631 and the orifice 651. Thus, when the cross sectional area of the orifice 631 is sufficiently larger than the cross sectional area of the orifice 651, the pressure decreasing speed of the nozzle needle back pressure chamber 53 at the time of discharging the fluid from the nozzle needle back pressure chamber 53 can be set only by setting the cross sectional area of the orifice 651. In contrast, the pressure increasing speed at the time of supplying the fluid to the nozzle needle back pressure chamber 53 can be set only by setting the cross sectional area of the orifice 631.

In FIG. 23A, the preloads of the coil springs 34, 38, which urge the first valve needle 33 and the armature 37, respectively, and the preload of the coil spring 32 (FIG. 1), which urges the nozzle needle 31, are set to decrease in the following order:

Coil Spring 32>Coil Spring 38>Coil Spring 34.

This is due to the following reason. First, the coil spring 32 defines the valve closing speed of the nozzle needle, so that the coil spring 32 requires the maximum preload. That is, at the time of starting the closing of the nozzle needle 31, the pressure of the nozzle chamber 51 and the pressure of the nozzle needle back pressure chamber 53 substantially coincide with each other, and also the pressure receiving area of the nozzle chamber 51 and the pressure receiving area of the nozzle needle back pressure chamber 53 substantially coincide with each other. Thus, the force, which is caused by the pressure of the nozzle chamber 51, and the force, which is caused by the pressure of the nozzle needle back pressure chamber 53, are substantially balanced to each other. Thus, the valve closing speed of the nozzle needle is set based on the urging force of the coil spring 32.

Next, the coil spring 38 needs to have the preload, which closes the port 66*a* against the high pressure fluid applied to the port 66*a*.Here, the diameter of the port 66*a* is denoted by "D5", and the pressure of the fluid applied to the port 66*a* is denoted by "P" (e.g., 200 MPa). In such a case, the required preload of the coil spring 38 is expressed as follows:

Preload of Coil Spring 38>$\pi/4\times D5\times D5\times P+\alpha$ where $\alpha$ is an extra force, for compensating an error or the like.

The coil spring 34 requires a little preload since the pressure of the valve back pressure chamber 55 and the pressure of the first control valve chamber 54 substantially coincide with each other, and therefore the valve back pressure chamber 55 and the first control valve chamber 54 are substantially balanced to each other. Here, the urging force for downwardly urging the first valve needle 33 is expressed by:

$$\pi/4\times D3\times D3\times P1+\text{spring preload}$$

where D3 is a diameter of the shaft portion 33*b* and P1 is a pressure of the valve back pressure chamber 55. The urging force for upwardly urging the first valve needle 33 is expressed by:

$$\pi/4\times(D3\times D3-D1\times D1)\times P2$$

where D1 is the diameter of the port 65*a*, and P2 is a pressure of the first control valve chamber 54, and D3>D1, and P1=P2. Thus, the hydraulic pressure applied to the first valve needle 33 is substantially balanced.

Additional advantages and modifications will readily occur to those skilled in the art. The invention in its broader terms is therefore not limited to the specific details, representative apparatus, and illustrative examples shown and described.

What is claimed is:

1. An injector comprising:

an elongated base body;

an injection hole, which penetrates through a wall of the base body to inject fuel;

a nozzle chamber, which is directly communicated with the injection hole on an upstream side of the injection hole in the base body and is supplied with pressurized fuel;

a nozzle needle, which is located in the nozzle chamber and is driven to enable and disable injection of the fuel through the injection hole;

a nozzle needle back pressure chamber, which is formed adjacent to a base end of the nozzle needle in the base body and is supplied with pressurized fuel to exert a back pressure of the nozzle needle for urging the nozzle needle toward the injection hole;

a release passage, which is formed in the base body to release the pressure of the nozzle needle back pressure chamber to an external low pressure source;

a control valve chamber, which is located in an intermediate part of the release passage in the base body;

a first control valve, which is located in the control valve chamber and is driven to connect and disconnect between the nozzle needle back pressure chamber and the low pressure source; and a valve drive means for driving the first control valve, wherein the valve drive means is a hydraulic valve drive means that includes:

a hydraulic pressure passage, which is formed in the base body, such that the hydraulic pressure passage is supplied with pressurized fuel and applies the pressurized fuel to the first control valve as control hydraulic fluid for driving the first control valve;

a second control valve, which is driven to control a flow of the fuel in the hydraulic pressure passage; and an actuator, which drives the second control valve.

2. The injector according to claim 1, wherein:

the control valve chamber is formed as a first control valve chamber;

the hydraulic pressure passage includes:

a valve back pressure chamber, which is formed adjacent to a base end of the first control valve and exerts a back pressure of the first control valve; and a second control valve chamber, which is formed on a downstream side of the valve back pressure chamber and receives the second control valve; and the second control valve is driven to connect and disconnect between the valve back pressure chamber and the low pressure source located on a downstream side of the back pressure chamber in the hydraulic pressure passage, so that the pressure of the valve back pressure chamber is decreased and is increased, respectively.

3. The injector according to claim 2, wherein:

a port is provided in the first control chamber in the base body;

the port is communicated with the low pressure source and is opened in a wall surface of the first control chamber in such a manner that the port is opposed to the first control valve in a moving direction of the first control valve;

the first control valve closes the port to increase the pressure of the valve back pressure chamber; and a choke is formed adjacent to the port on a downstream side of the port in the base body.

4. The injector according to claim 1, wherein:

the base body includes a fuel supply passage, which extends in an axial direction of the base body and supplies the pressurized fuel to the nozzle chamber;

an enlarged cross sectional portion is made in the fuel supply passage to form an accumulator chamber, which limits pressure drop of the nozzle chamber during the injection of fuel through the injection hole;

the base body includes a distal end part and a base end part, which are divided along an imaginary line that transversely crosses the accumulator chamber and are joined together by diffusion bonding;

the distal end part has a hole, which forms a part of the fuel supply passage;

the base end part has a hole, which forms another part of the fuel supply passage;

a cross sectional area of at least one of the hole of the distal end part and the hole of the base end part is enlarged along a predetermined axial extent, which begins from a joint end surface between the distal end part and the base end part, to form the enlarged cross sectional portion and thereby to form the accumulator chamber.

5. The injector according to claim 1, wherein:

the base body includes a fuel supply passage, which supplies the pressurized fuel to the nozzle chamber; and the fuel supply passage and the control valve chamber, which receives the first control valve, are always connected to one another through a communication passage, which is formed in the base body and has a choke.

6. The injector according to claim 1, wherein:

the second control valve is provided with an armature, which is received in a receiving chamber formed in the base body and is moves integrally with the second control valve;

the actuator is a solenoid, which attracts the armature upon energization of the solenoid;

a passage is provided in the base body between the receiving chamber and the release passage and receives a check valve;

when a pressure of the receiving chamber exceeds a predetermined low pressure, the check valve is opened to release the pressure of the receiving chamber; and the check valve limits flow of fuel into the receiving chamber though the check valve.

* * * * *